US005814427A

United States Patent [19]

Murofushi et al.

[11] Patent Number: 5,814,427

[45] Date of Patent: Sep. 29, 1998

[54] DECOLORIZABLE TONER AND PROCESS FOR PREPARING THE SAME

[75] Inventors: Katsumi Murofushi; Yoshikazu Hosoda; Akira Yamauchi, all of Kawasaki; Yuki Abe, Kobe; Harushi Nagami, Kobe; Kiyotaka Yamaguchi, Kobe; Takayuki Yoshida, Kobe; Mitsuhiro Uchino, Kobe, all of Japan

[73] Assignees: Bando Chemical Industries, Ltd., Kobe; Showa Denko K.K., Tokyo, both of Japan

[21] Appl. No.: 481,321

[22] PCT Filed: Oct. 31, 1994

[86] PCT No.: PCT/JP94/01837

§ 371 Date: Jul. 3, 1995

§ 102(e) Date: Jul. 3, 1995

[87] PCT Pub. No.: WO95/12838

PCT Pub. Date: May 11, 1995

[30] Foreign Application Priority Data

| | | | |
|---|---|---|---|
| Nov. 5, 1993 | [JP] | Japan | 5-276680 |
| Apr. 4, 1994 | [JP] | Japan | 6-066059 |

[51] Int. Cl.[6] ..... G03G 9/087

[52] U.S. Cl. ..... 430/109; 430/106; 430/110; 430/111; 430/137

[58] Field of Search ..... 430/110, 106, 430/137, 111, 109

[56] References Cited

U.S. PATENT DOCUMENTS

| | | | |
|---|---|---|---|
| 4,404,270 | 9/1983 | Higashida et al. | 430/110 |
| 5,045,420 | 9/1991 | Hosono et al. . | |
| 5,166,041 | 11/1992 | Murofushi et al. | 430/339 |
| 5,362,592 | 11/1994 | Murofushi et al. | 430/110 |
| 5,449,583 | 9/1995 | Murofushi et al. | 430/137 |

FOREIGN PATENT DOCUMENTS

| | | |
|---|---|---|
| 379 157 | 7/1990 | European Pat. Off. . |
| 542 286 | 5/1993 | European Pat. Off. . |
| 3120542 | 3/1982 | Germany . |
| 5-197196 | 8/1983 | Japan . |
| 5-173361 | 7/1993 | Japan . |
| 5-197197 | 8/1993 | Japan . |
| 5-241369 | 9/1993 | Japan . |

OTHER PUBLICATIONS

B. Elvers, et al., ed *Ullmann's Encyclopedia of Industrial Chemistry*, Fifth Edition, VCH Publishers, Inc. (1993) vol. A23, pp. 1, 84–86, and vol. A19, pp. 373, 378.

Official Copy by Japanese Standards Association of Japanese Industrial Standard J15Z8729, Edition 1, Tokyo, Japan, Japanese Standards Association (1988) pp. 1–12.

Patent & Trademark Office English Language of Japanese Patent 5–197197 (Pub Aug. 1993).

Japio Abs. vol. 8 No. 188 (P297) (1625) Pub Aug. 29, 1984 of JP 59–78364.

Japio Abstract vol. 7 No. 206 (P222) (1351) Pub Sep. 10, 1983 of JP 58–102247.

Japio Abstract vol. 9 No. 190 (P378) (1913) Pub Aug. 7, 1985 of JP 60–57857.

Japio Abstract vol. 13 No. 27 (P815) (3375) Pub Jan. 20, 1989 of JP 63–226665.

*Primary Examiner*—Janis L. Dote

*Attorney, Agent, or Firm*—Armstrong, Westerman, Hattori, McLeland & Naughton

[57] ABSTRACT

What is disclosed a decolorizable toner of which main components are a visible ray-near infrared ray-absorbing dye, a decolorizing agent and a resin binder, characterized in that a resin binder A containing the visible ray-near infrared ray-absorbing dye is dispersed in a resin binder B and that the decolorizing agent is blended with at least one of the resin binder A and the resin binder B, and a process for preparing the same. The visible ray-near infrared ray-decolorizable toner of the present invention can be speedily decolorized by irradiating with visible rays to near infrared rays. Also, according to the process of the present invention, it is easy to adjust its electrically charged amount by a material having electrification property, and there is obtained a visible ray-near infrared ray-decolorizable toner which is hardly faded during the kneading in the production of the toner.

9 Claims, 2 Drawing Sheets

DECOLORIZABLE TONER AND PROCESS FOR PREPARING THE SAME

TECHNICAL FIELD

The present invention relates to a decolorizable toner and a process for preparing the same, and more particularly to a decolorizable toner which can make an electric latent image or an electric signal used in electrophotography, electrostatic recording materials and the like visible, and a process for preparing the same.

BACKGROUND ART

In recent years, for the purpose of protection of natural environment, in particular protection of forest resources, and diminution of refuse in cities, reuse or recycling of used papers has been reconsidered. As a part thereof, reuse of waste papers such as useless used copied paper, printed paper and facsimile paper which are generated in offices of enterprise or the like has been studied.

However, since confidential papers of the inside of enterprises, which are generally dealed with industrial secrets, occupy the most part of these waste papers, it is extremely difficult that these waste papers are collected and recycled by a paper-manufacturing company which is outside the enterprises. Moreover, since a recorded part or printed part of a printed matter, a duplicate or the like cannot be easily erased, these waste papers are obliged to be disposed by incinerating or shredding. Therefore, it is thought that reuse of such papers or the like is actually almost impossible. Also, as to recycling of waste papers which are shredded by means of a shredder or the like, some studies have been carried out. However, since the strength of recycled papers produced by using such shredded waste papers is generally low, there was a defect that the recycled papers do not endure the using as, for instance, information paper and the like.

Thereupon, as a method for recycling these waste papers easily and safely, it is proposed that after copying or printing with a decolorizable toner in which a resin binder containing a decolorizable dye having a characteristic of being decolorized by near infrared rays is contained, the decolorizable toner is decolorized by irradiating with near infrared rays (Japanese Unexamined Patent Publication No. 362935/1992, Japanese Unexamined Patent Publication No. 119520/1993).

However, as to the above decolorizable toner, (A) since a decolorizable dye exhibits strong positive electrification property, it is difficult to control an electrically charged amount of the obtained decolorizable toner, and (B) due to the interaction between the decolorizable dye and an agent for imparting characteristics to a toner such as an electric charge regulator, the decolorizable dye is decolorized during the production of a toner, and after the production of the toner, problems arised in decolorizing property of the toner and its quality of image.

The present invention has been accomplished in consideration of the above-mentioned prior art. The present invention aims at providing a process for preparing a decolorizable toner, in which an electrically charged amount of an obtained decolorizable toner is easily adjusted and a dye is hard to be decolorized during kneading in the production of a toner, and a decolorizable toner which can be speedily decolorized during its erasure.

DISCLOSURE OF INVENTION

The present invention relates to (1) a decolorizable toner of which main components are a visible ray-near infrared ray-absorbing dye, a decolorizing agent and a resin binder, characterized in that a resin binder A with which the visible ray-near infrared ray-absorbing dye is blended is dispersed in a resin binder B, and that the decolorizing agent is blended with at least one of the resin binder A and the resin binder B, (2) a process for preparing a decolorizable toner of which main components are a visible ray-near infrared ray-absorbing dye, a decolorizing agent and a resin binder, characterized by heating to melt and kneading a resin binder A which contains the visible ray-near infrared ray-absorbing dye and the decolorizing agent, and a resin binder B, cooling and thereafter pulverizing them, and (3) a process for preparing a decolorizable toner of which main components are a visible ray-near infrared ray-absorbing dye, a decolorizing agent and a resin binder, characterized by heating to melt and kneading a resin binder A which contains the visible ray-near infrared ray-absorbing dye, and a resin binder B and the decolorizing agent, cooling and thereafter pulverizing them.

BEST MODE FOR CARRYING OUT THE INVENTION

Figure 1:
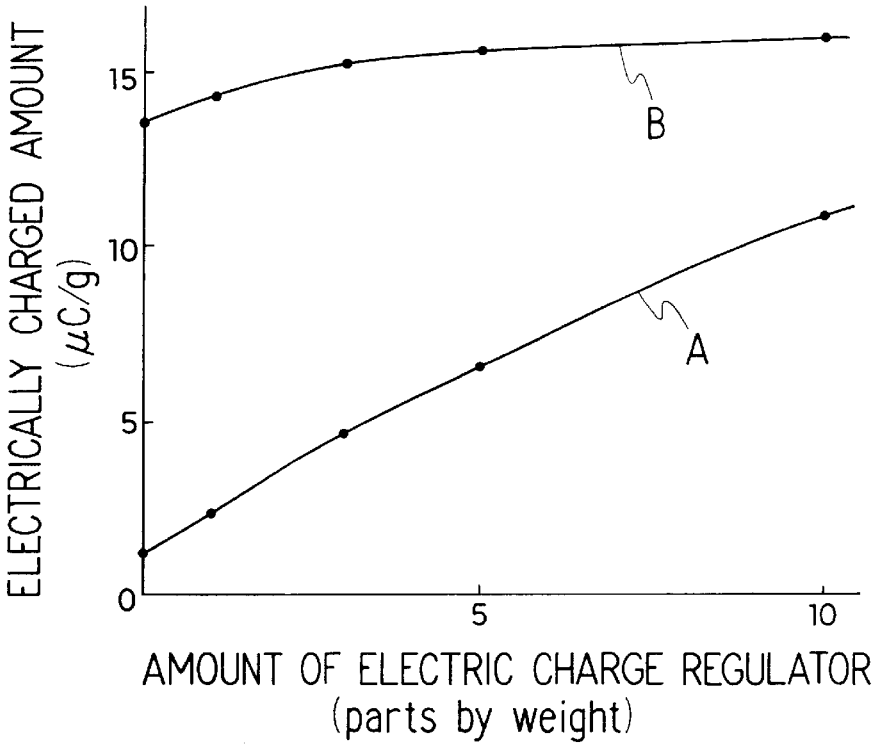
FIG. 1 is a graph showing the relation between the amount of the electric charge regulator and the electrically charged amount of the decolorizable toners obtained in Examples 23 to 27 and Comparative Examples 11 to 15.

The decolorizable toner of the present invention of which main components are a visible ray-near infrared ray-absorbing dye, a decolorizing agent and a resin binder, wherein a resin binder A with which the visible ray-near infrared ray-absorbing dye is blended is dispersed in a resin binder B, and the decolorizing agent is blended with at least one of the resin binder A and the resin binder B.

According to the process of the present invention, the decolorizable toner is obtained by (A) heating to melt and kneading a resin binder A which contains a visible ray-near infrared ray-absorbing dye and a decolorizing agent, and a resin bidner B, cooling and thereafter pulverizing them (hereinafter referred to as process invention I), or (B) heating to melt and kneading a resin binder A which contains a visible ray-near infrared ray-absorbing dye, and a resin binder B and a decolorizing agent, cooling and thereafter pulverizing them (hereinafter referred to as process invention II).

According to the process inventions I and II, the visible ray-near infrared ray-absorbing dye which shows strong positive electrification property is incorporated in the resin binder A, and the resin binder A in which the visible ray-near infrared ray-absorbing dye is incorporated is dispersed in the resin binder B. Therefore, for instance, by blending an electric charge regulator and the like with the resin binder B, it becomes easy to control the electric charged amount of the decolorizable toner because it is difficult that the decolorizable toner is affected by the positive electrification property based on the visible ray-near infrared ray-absorbing dye when controlling the electrically charged amount of the obtained decolorizable toner. Also, as mentioned above, the visible ray-near infrared ray-absorbing dye is incorporated in the resin binder A, and difficult to be contacted with an agent for imparting characteristics to a toner, for instance, an electric charge regulator or the like, which is blended with the resin binder B. Therefore, such problems that the decolorizing property of the obtained decolorizable toner is lowered and that quality of image is deteriorates due to the interaction of both are solved.

Also, when resin binders which do not show compatibility with each other are used as the resin binder A and the resin binder B, both of the resin binders A and B are dispersed in an island-in-sea structure during heating to melt and kneading them but they are incompatible with each other. Therefore, the strong positive electrification property of the visible ray-near infrared ray-absorbing dye becomes hard to be exhibited on the surface of an obtained decolorizable toner. Also, when a material having electrification property such as electric charge regulator is contained in the resin binder B, since the resin binder A and the resin binder B containing a material having electrification property do not show compatibility with each other, it is avoided that the visible ray-near infrared ray-absorbing dye and the decolorizing agent are directly contacted with the material having electrification property. Therefore, during the kneading in the production of a decolorizable toner, it is avoided that the visible ray-near infrared ray-absorbing dye is faded by the material having electrification property. At the same time, since the material having electrification property is not so affected by the strong positive electrification property of the visible ray-near infrared ray-absorbing property, it becomes easy that a tribo-electrically charged amount of an obtained decolorizable toner is adjusted to a predetermined value.

Also, as the above resin binder A, when a resin binder having an acid value of 8 to 30 mgKOH/g is used, fading is avoided during the production of a decolorizable toner, and light resistance of the obtained decolorizable toner is increased.

Furthermore, resin binders essentially have pale color in general. Among them, when a resin binder having b*value of not more than 20 in a 30% ethyl acetate solution in the chromaticity coordinates of L*a*b according to a color-difference meter is used as, especially, the resin binder A, a decolorization-treated image, which is produced by forming an image on a sheet of copying paper with the obtained decolorizable toner and then irradiating the formed image with visible rays to near infrared rays, comes to be hardly tinged with yellow. Therefore, reusability of the copying paper is still more improved.

Also, as to the process invention I, when a resin binder A containing a visible ray-near infrared ray-absorbing dye and a decolorizing agent is prepared by dissolving a visible ray-near infrared ray-absorbing dye, a decolorizing agent and a resin binder A in an organic solvent, blending or kneading them, and thereafter removing the organic solvent, or as to the process invention II, when a resin binder A containing a visible ray-near infrared ray-absorbing dye is prepared by dissolving a visible ray-near infrared ray-absorbing dye and a resin binder A in an organic solvent, blending or kneading them, and thereafter removing the organic solvent, it hardly occurs during heating to melt and kneading that the visible ray-near infrared ray-absorbing dye is discolored, faded or decolorized, which occurs when prepared by heating to melt and kneading without an organic solvent.

As the concrete examples of the above resin binder A and the resin binder B, there are cited, for instance, homopolymers of styrene and their substitution products such as polystyrene, poly-p-chlorostyrene and polyvinyltoluene, styrene-acrylic copolymers such as a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-octyl methacrylate copolymer, a styrene-methyl α-chloromethacrylate copolymer, a styrene-hydroxyethyl acrylate copolymer, a styrene-acrylic acid ester-hydroxyethyl acrylate copolymer and a styrene-hydroxypropyl acrylate copolymer, styrene-acrylonitrile copolymers such as a styrene-acrylonitrile copolymer, a styrene acrylic rubber-acrylonitrile copolymer, a styrene-EPDM-acrylonitrile copolymer, a styrene-butadiene-acrylonitrile copolymer and a styrene-chlorinated polyethylene-acrylonitrile copolymer, the other styrene copolymers such as a styrene-p-chlorostyrene copolymer, a styrene-propylene copolymer, a styrene-vinyltoluene copolymer, a styrene vinylnaphthalene copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-acrylonitrile-indene copolymer, a styrene-maleic acid copolymer and a styrene-maleic acid ester copolymer, (meth)acrylic resins represented by polyacrylic acid, polymethyl methacrylate, polybutyl methacrylate, polyhydroxymethyl acrylate, polyhydroxyethyl acrylate, polyhydroxypropyl acrylate, polyhydroxymethyl methacrylate, polyhydroxyethyl methacrylate, polyhydroxypropyl methacrylate and the like, polyester resins represented by saturated polyester, unsaturated polyester and the like, ethylene-vinyl acetate copolymers such as an ethylene-vinyl acetate copolymer and a denatured ethylene-vinyl acetate copolymer, olefin resins such as polyethylene and polypropylene, an epoxy resin, a vinyl chloride resin, a silicone resin, a fluorocarbon resin, a polyamide resin, a polyvinyl alcohol resin, a polyurethane resin, polyvinyl butyral, rosin, denaturated rosin, a rosin-modified phenol-formaldehyde resin, a phenol-formaldehyde resin, a phenolic resin, a vinyl acetate resin, a terpene resin, an aliphatic or alicyclic hydrocarbon resin, an aromatic petroleum resin, a chlorinated paraffin, a paraffin wax, carnauba wax, and the like. The present invention is not limited only to the exemplified ones. The resin binder A and the resin binder B may be the same or different. These resin binders are usually used alone or in an admixture thereof. Among these concrete examples of the resin binder, there can be particularly preferably used a resin binder whose polarity is large such as a resin whose polarity is large and which has at least one group selected from hydroxyl group, cyano group, carboxyl group and carbonyl group in its molecule, such as polyester resins, epoxy resins, (meth)acrylic resins, polyamide resins, polyvinyl alcohol resins, polyurethane resins, polyacrylonitrile resins, polyvinyl acetate resins, phenolic resins, styrene-acrylic copolymers, styrene-acrylonitrile copolymers, ethylene-vinyl acetate copolymers or ethylene-acrylic acid copolymers since these resin binders impart more excellent fading resistance.

Moreover, in the present invention, it is preferable that the resin binder A and the resin binder B show incompatiblity with each other. Thus, when the resin binder A and the resin binder B are insoluble with each other, as mentioned above, strong positive electrification property of the visible ray-near infrared ray-absorbing dye becomes hard to be exhibited on the surface of an obtained decolorizable toner. Also, when a material having electrification property such as electric charge regulator is contained in the resin binder B, it is avoided that the visible ray-near infrared ray-absorbing dye is faded or discolored by the material having electrification property during the kneading in the production of the decolorizable toner, and the material having electrification property is not so much affected by the strong positive electrification property of the visible ray-near infrared ray-absorbing dye. Therefore, there is an advantage that it becomes easy to adjust the tribo-electrically charged amount of an obtained decolorizable toner to a predetermined value.

Among the above concrete examples of the resin binder A and the resin binder B, a styrene-acrylic acid ester copolymer and a polyester resin can be particularly preferably used as the resin binder A and the resin binder B which do not show compatibility with each other.

There are various criteria of incompatibility of the above resin binder A and the resin binder B. In the present invention, the criteria of incompatibility is determined by the cloudiness which is recognized when each 0.2 g of two members of resin binders whose compatibility is to be evaluated is employed and dissolved in about 20 ml of a solvent in which both the resin binders can be dissolved such as tetrahydrofuran or dichloromethane, 10 ml of the solution of each resin binder is mixed together, they are stirred to be a uniform composition, then the obtained mixed solution is cast on a glass plate such as slide glass, the solvent is removed by air drying, and turbidity of a formed film having a thickness of about 100 $\mu$m is observed on the glass plate with naked eyes. Moreover, when using a resin binder which exhibits substantial solubility or insolubility to an organic solvent, the criteria of incompatibility is determined by ascertaining a phase separation structure when observing a film formed by heating to melt each of two members of resin binders, mixing them with each other to be a uniform composition and thereafter cooling them, by means of a microscope.

Moreover, in the present invention, one or more members selected from the above exemplified resin binders can be used as each of the resin binder A and the resin binder B as far as the resin binder A and the resin binder B are insoluble with each other.

It is preferable that a resin binder having an acid value of not less than 8 mgKOH/g, particularly not less than 10 mgKOH/g, the acid value of which is measured in accordance with JIS K 0070 (1992), is used as the above resin binder A in order to avoid fading in the production of a decolorizable toner and improve weather resistance of an obtained decolorizable toner and storage stability of a formed image. In addition, it is preferable that the acid value is adjusted to not more than 30 mgKOH/g, particularly not more than 20 mgKOH/g since the resin binder comes to deteriorate in moisture resistance and decolorizing property when the acid value is too large.

Also, it is desired that a resin binder, which has b*value of not more than 20, preferably −20 to 20, more preferably −5 to 20 in the chromaticity coordinates of L*a*b by means of a color-difference meter in a 30% ethyl acetate solution of the resin binder, is used as the above resin binder A in order to avoid the remained color when an image formed with an obtained decolorizable toner is irradiated with visible rays to near infrared rays.

Moreover, in the present invention, each of L*value, a*value and b*value is a value determined by the measurement of transmitted light with a 30% ethyl acetate solution of a resin binder by means of a color-difference meter "Z-Σ90 COLOR MEASURING SYSTEM" made by NIPPON DENSHOKU KOGYO CO., LTD.

The larger L*value becomes, the larger lightness becomes, and the smaller L*value becomes, the smaller lightness becomes. The larger a*value becomes, the more it becomes greenish, and the smaller a*value becomes, the more it becomes reddish. Moreover, the larger b*value becomes, the more it becomes yellowish, the more b*value approaches 0, the more it becomes colorless, and furthermore, the larger a negative value of b*value becomes, the more it becomes blueish.

By the way, the reason why b*value is particularly adjusted to not more than 20 in the present invention is that when b*value exceeds 20, the resin binder is colored in yellow and the coloration in yellow exerts a bad influence upon a hue of an image after decolorization.

It is desired that the ratio of the above resin binder A to the resin binder B (the resin binder A/the resin binder B: ratio by weight) is adjusted to not less than 5/95, particularly not less than 8/92 since there is a tendency that colorability of obtained toner particles becomes wrong when the ratio is too small, and also, the ratio is adjusted to not more than 50/50, particularly not more than 45/55 since there is a tendency that the phase separation of the resin binder A and the resin binder B is hardly generated when the ratio is too large.

When the decolorizable toner is prepared in such a ratio of the resin binder A to the resin binder B, the ratio of the resin binder A is relatively smaller than the ratio of the resin binder B. Therefore, a decolorizable toner having a so-called "island-in-sea structure" in which the resin binder A constitutes "island" and the resin binder B constitutes "sea" is obtained. Accordingly, since the obtained decolorizable toner has a structure that the visible ray-near infrared ray-absorbing dye and the decolorizing agent are incorporated in the "island" composed of the resin binder A, and a structure that the above "island" is dispersed in the "sea" composed of the resin binder B, the strong positive electrification property of the visible ray-near infrared ray-absorbing dye becomes hard to be exhibited on the surface of an obtained decolorizable toner in comparison with the case of using one kind of the resin binders in which the visible ray-near infrared ray-absorbing dye is dispersed.

Moreover, in the present invention, as occasion demands, wax such as polyolefin wax or paraffin wax or the like is blended with the resin binder.

It is desired that the amount of the above wax is not less than 0.1 part, preferably not less than 0.5 part per 100 parts (parts by weight, hereinafter referred to the same) of the total amount of the resin binder A and the resin binder B (hereinafter referred to as total resin binders) in order to sufficiently exhibit effects shown by blending the wax, such as effect for preventing offset. However, when the amount of the wax is too large, there is a tendency that film-forming or the like is easily generated on a photo-sensitive body on which an electric latent image is produced. Therefore, it is desired that the amount is adjusted to not more than 20 parts, preferably not more than 10 parts per 100 parts of the total resin binders.

As a typical example of the visible ray-near infrared ray-absorbing dye used in the present invention, there can be cited, for instance, a cationic dye represented by the general formula (I):

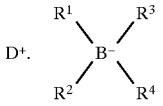

(I)

wherein $D^+$ is a cation showing absorption in the visible region to the near infrared region, each of $R^1$, $R^2$, $R^3$ and $R^4$ is independently an alkyl group, an aryl group, allyl group, an aralkyl group, an alkenyl group, an alkynyl group, silyl group, a heterocyclic group, a substituted alkyl group, a substituted aryl group, a substituted allyl group, a substituted aralkyl group, a substituted alkenyl group, a substituted alkynyl group or a substituted silyl group, or a cationic dye represented by the general formula (II):

$$D^+.\ A^- \qquad \text{(II)}$$

wherein $D^+$ is a cation showing absorption in the visible region to the near infrared region, $A^-$ is a halogen ion, perchloric acid ion, $PF_6^-$, $SbF_6^-$, $BF_4^-$ or sulfonic acid ion.

As the halogen ion, fluorine ion, chlorine ion, bromine ion and iodine ion can be cited. Also, as the sulfonic acid ion, for instance, a methylsulfonic acid ion such as $CH_3SO_3^-$, substituted methylsulfonic acid ions such as $FCH_2SO_3^-$, $F_2CHSO_3^-$, $F_3CSO_3^-$, $ClCH_2SO_3^-$, $Cl_2CHSO_3^-$, $Cl_3CSO_3^-$, $CH_3OCH_2SO_3^-$ and $(CH_3)_2NCH_2SO_3^-$, a phenylsulfonic acid ion such as $C_6H_5SO_3^-$, substituted phenylsulfonic acid ions such as $CH_3C_6H_4SO_3^-$, $(CH_3)_2C_6H_3SO_3^-$, $(CH_3)_3C_6H_2SO_3^-$, $HOC_6H_4SO_3^-$, $(HO)_2C_6H_3SO_3^-$, $(HO)_3C_6H_2SO_3^-$, $CH_3OC_6H_4SO_3^-$, $C_6H_4ClSO_3^-$, $C_6H_3Cl_2SO^-_3$, $C_6H_2Cl_3SO_3^-$, $C_6HCl_4SO_3^-$, $C_6Cl_5SO_3^-$, $C_6H_4FSO_3^-$, $C_6H_3F_2SO_3^-$, $C_6H_2F_3SO_3^-$, $C_6HF_4SO_3^-$, $C_6F_5SO_3^-$ and $(CH_3)_2NC_6H_4SO_3^-$, and the like can be cited.

Also, in the above general formula (I), as concrete examples of $R^1$, $R^2$, $R^3$ and $R^4$, there can be cited, for instance, hydrogen atom, an alkyl group, an aryl group, allyl group, an aralkyl group, an alkenyl group, an alkynyl group, silyl group, a heterocyclic group, a substituted alkyl group, a substituted aryl group, a substituted allyl group, a substituted aralkyl group, a substituted alkenyl group, a substituted alkynyl group, a substituted silyl group and the like. Among them, as preferable ones, there can be cited, for instance, hydrogen atom, phenyl group, anisyl group, ethoxyphenyl group, toluyl group, t-butylphenyl group, fluorophenyl group, chlorophenyl group, diethylaminophenyl group, xylyl group, n-butyl group, n-pentyl group, n-hexyl group, n-heptyl group, n-octyl group, n-dodecyl group, cyclohexyl group, cyclohexenyl group, methoxymethyl group, methoxyethyl group, vinyl group, allyl group, triphenylsilyl group, dimethylphenylsilyl group, dibutylphenylsilyl group, trimethylsilyl group, piperidyl group, thienyl group, furyl group and the like. Also, it is preferable that at least one of $R^1$, $R^2$, $R^3$ and $R^4$ is an alkyl group having 1 to 12 carbon atoms. Among the alkyl groups, as preferable ones, there can be cited, for instance, alkyl groups having 4 to 12 carbon atoms such as n-butyl group, n-pentyl group, n-hexyl group, n-heptyl group, n-octyl group and n-dodecyl group. As concrete examples of anions, there can be cited, for instance, n-methyltriphenylborate ion, n-ethyltriphenylborate ion, n-butyltriphenylborate ion, n-octyltriphenylborate ion, n-dodecyltriphenylborate ion, n-methyltri-p-tolylborate ion, n-ethyltri-p-tolylborate ion, n-butyltri-p-tolylborate ion, n-octyltri-p-tolylborate ion, n-dodecyltri-p-tolylborate ion, n-methyltrianisylborate ion, n-ethyltrianisylborate ion, n-butyltrianisylborate ion, n-octyltrianisylborate ion, n-dodecyltrianisylborate ion, di-n-methyldiphenylborate ion, di-n-ethyldiphenylborate ion, di-n-butyldiphenylborate ion, di-n-octyldiphenylborate ion, di-n-dodecyldiphenylborate ion, di-n-methyldi-p-tolylborate ion, di-n-ethyldi-p-tolylborate ion, di-n-butyldi-p-tolylborate ion, di-n-octyldi-p-tolylborate ion, di-n-dodecyldi-p-tolylborate ion, di-n-methyldianisylborate ion, di-n-ethyldianisylborate ion, di-n-butyldianisylborate ion, di-n-octyldianisylborate ion, di-n-dodecyldianisylborate ion, tetraphenylborate ion, tetraanisylborate ion, tetra-p-tolylborate ion, triphenylnaphtylborate ion, tri-p-tolylnaphtylborate ion, tetrabutylborate ion, tri-n-butyl(triphenylsilyl)borate ion, tri-n-butyl(dimethylphenylsilyl)borate ion, n-octyldiphenyl(di-n-butylphenylsilyl)borate ion, dimethylphenyl(trimethylsilyl)borate ion, and the like.

Also, in the visible ray-near infrared ray-absorbing dye represented by the above general formula (I), as preferable ones of the cation ($D^+$), there can be cited cationic dyes of cyanine, triarylmethane, aminium, diimmonium, thiazine, xanthene, thiazine, oxazine, diallylmethane, triallylmethane, styryl, pyrylium, thiopyrylium, and the like. As typical examples of the cationic dye, for instance, dyes described in Table 1, and the like can be cited.

TABLE 1

| Dye No. | Structure | $R^1$ | $R^2$ | $R^3$ | $R^4$ | $R^5$ | n | X | Ar |
|---|---|---|---|---|---|---|---|---|---|
| 1-A | 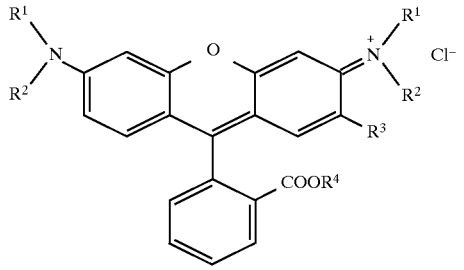 | H | H | H | H | | | | |
| -B | | H | H | H | Me | | | | |
| -C | | Me | Me | H | Me | | | | |
| -D | | Et | Et | H | Et | | | | |
| -E | | H | Et | Me | H | | | | |
| -F | | H | Et | Me | Me | | | | |

TABLE 1-continued
| Dye No. | Structure | $R^1$ | $R^2$ | $R^3$ | $R^4$ | $R^5$ | n | X | Ar |
|---|---|---|---|---|---|---|---|---|---|
| 2-A | 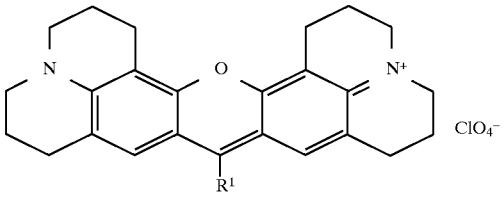 | H | | | | | | | |
| -B | | CN | | | | | | | |
| -C | | 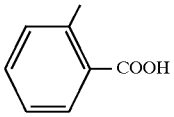 | | | | | | | |
| -D | | 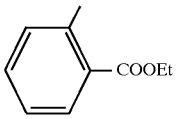 | | | | | | | |
| 3-A | 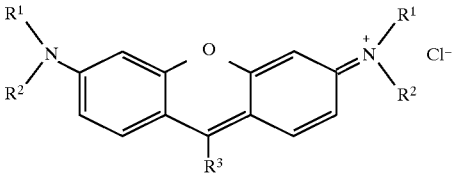 | Me | Me | H | | | | | |
| -B | | Et | Et | H | | | | | |
| -C | | Me | Me | CN | | | | | |
| 4 | 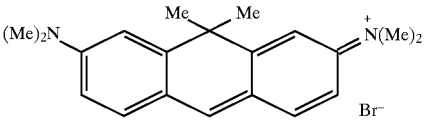 | | | | | | | | |
| 5-A | 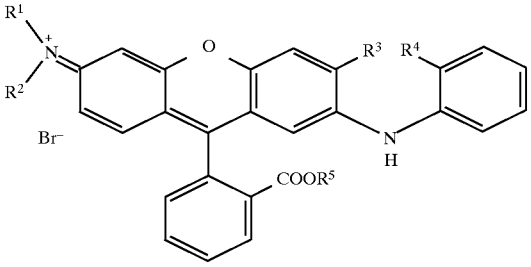 | c-Hex | Me | Me | H | Et | | | |
| -B | | c-Hex | Me | Me | H | All | | | |
| -C | | Et | Et | Me | H | Et | | | |
| -D | | Et | Et | H | Cl | All | | | |
| -E | | Et | Et | Cl | H | n-Bu | | | |
| -F | | n-Bu | n-Bu | H | Cl | n-Bu | | | |
| -G | | Tol | Et | Me | H | Bz | | | |
| 6-A | 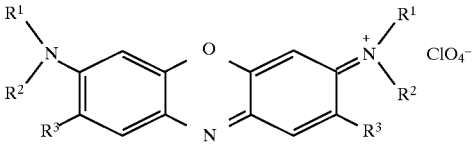 | Et | Et | H | | | | | |
| -B | | H | Et | Me | | | | | |
| 7-A | 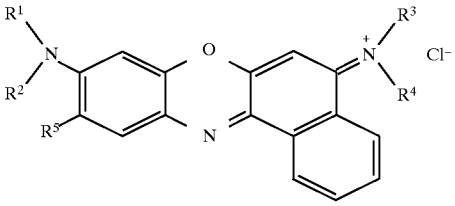 | H | H | H | H | H | | | |
| -B | | H | Et | H | Et | H | | | |
| -C | | Me | Me | Me | Me | H | | | |
| -D | | H | Et | H | Et | Me | | | |
| 8-A | 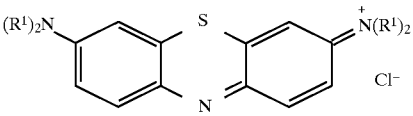 | H | | | | | | | |
| -B | | Me | | | | | | | |

TABLE 1-continued
| Dye No. | Structure | $R^1$ | $R^2$ | $R^3$ | $R^4$ | $R^5$ | n | X | Ar |
|---|---|---|---|---|---|---|---|---|---|
| 9 | 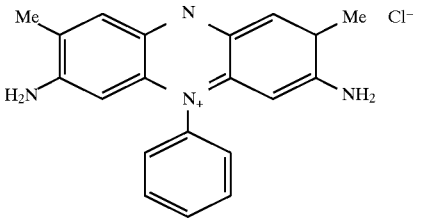 | | | | | | | | |
| 10-A | 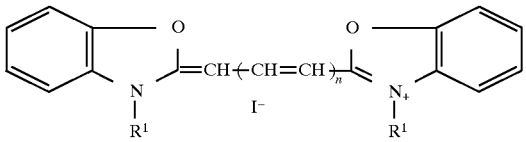 | Me | | | | | 0 | | |
| -B | | Et | | | | | 1 | | |
| -C | | n-Hex | | | | | 1 | | |
| -D | | Me | | | | | 2 | | |
| -E | | Et | | | | | 2 | | |
| -F | | Et | | | | | 3 | | |
| 11-A | 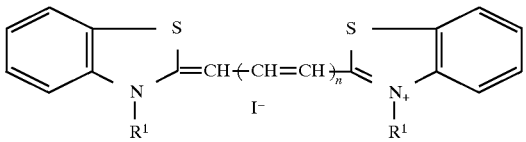 | Me | | | | | 0 | | |
| -B | | Et | | | | | 1 | | |
| -C | | n-Hep | | | | | 1 | | |
| -D | | Me | | | | | 2 | | |
| -E | | Et | | | | | 2 | | |
| -F | | n-Hep | | | | | 2 | | |
| 12-A | 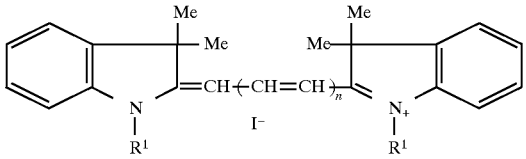 | Me | | | | | 0 | | |
| -B | | Me | | | | | 1 | | |
| -C | | Et | | | | | 1 | | |
| -D | | Me | | | | | 2 | | |
| -E | | Et | | | | | 2 | | |
| -F | | n-Hep | | | | | 2 | | |
| 13 | 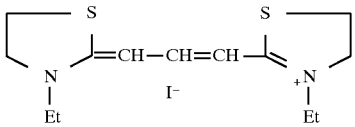 | | | | | | | | |
| 14-A | 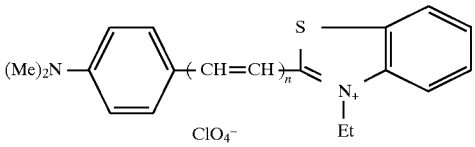 | | | | | | 1 | | |
| -B | | | | | | | 2 | | |
| 15-A | 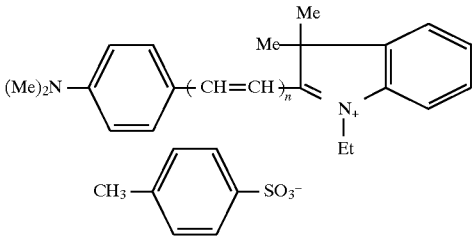 | | | | | | 1 | | |
| -B | | | | | | | 2 | | |
| 16-A | 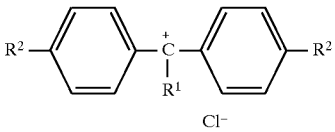 | H | $N(Me)_2$ | | | | | | |
| -B | | Me | $N(Me)_2$ | | | | | | |
| -C | | $NH_2$ | $N(Me)_2$ | | | | | | |
| -D | | CN | $N(Me)_2$ | | | | | | |
| -E | | Cl | $N(Me)_2$ | | | | | | |
| -F | | COOH | H | | | | | | |
| 17 | 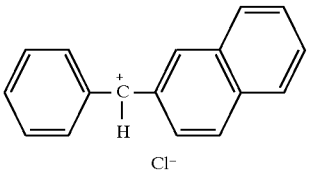 | | | | | | | | |

TABLE 1-continued
| Dye No. | Structure | $R^1$ | $R^2$ | $R^3$ | $R^4$ | $R^5$ | n | X | Ar |
|---|---|---|---|---|---|---|---|---|---|
| 18 | 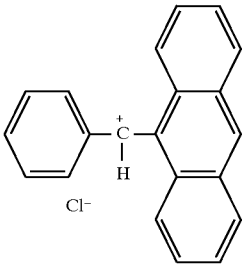 | | | | | | | | |
| 19-A<br>-B | 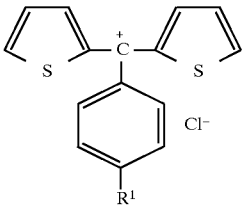 | H<br>$N(Me)_2$ | | | | | | | |
| 20-A<br>-B<br>-C<br>-D<br>-E<br>-F | 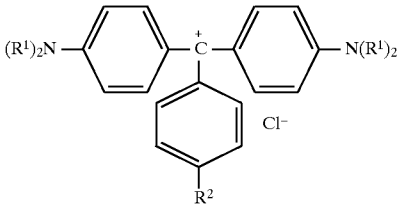 | Me<br>Et<br>Me<br>Et<br>Et<br>Me | H<br>OMe<br>CN<br>$N(Et)_2$<br>Cl<br>$N(Me)_2$ | | | | | | |
| 21 | 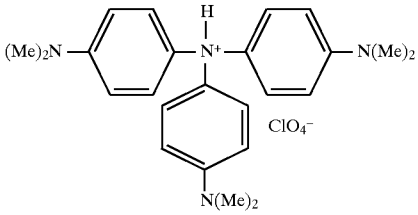 | | | | | | | | |
| 22 | 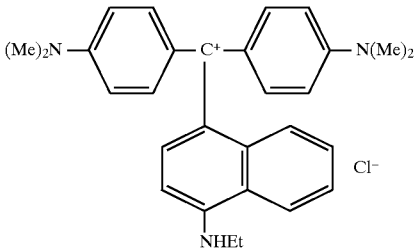 | | | | | | | | |
| 23 | 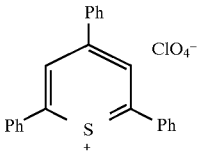 | | | | | | | | |
| 24 | 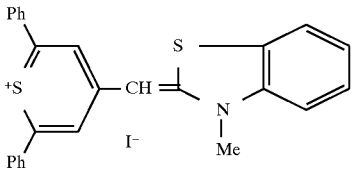 | | | | | | | | |

TABLE 1-continued
| Dye No. | Structure | $R^1$ | $R^2$ | $R^3$ | $R^4$ | $R^5$ | n | X | Ar |
|---|---|---|---|---|---|---|---|---|---|
| 25 | 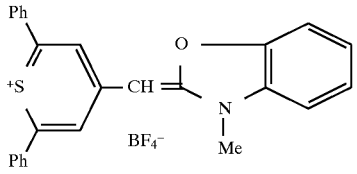 | | | | | | | | |
| 26 | 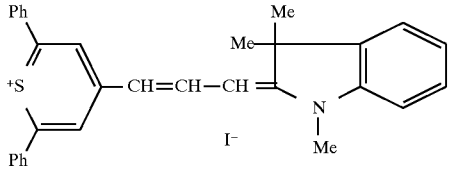 | | | | | | | | |
| 27 | 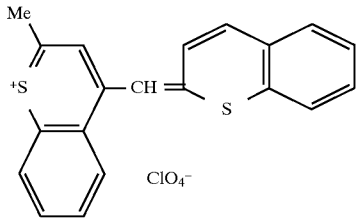 | | | | | | | | |
| 28-A | 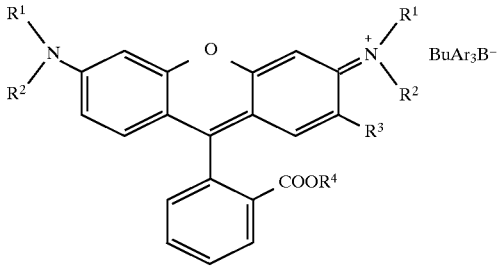 | H | H | H | H | | | | Ph |
| -B | | H | H | H | Me | | | | Ph |
| -C | | Me | Me | H | Me | | | | Tol |
| -D | | Et | Et | H | Et | | | | Tol |
| -E | | H | Et | Me | H | | | | Ph |
| -F | | H | Et | Me | Me | | | | Ph |
| 29-A | 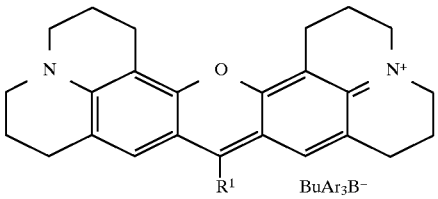 | H | | | | | | | Tol |
| -B | | CN | | | | | | | Ph |
| -C | | 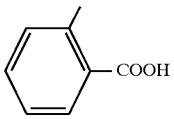 | | | | | | | Ph |
| -D | | 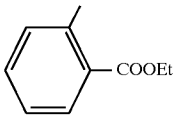 | | | | | | | Tol |
| 30-A | 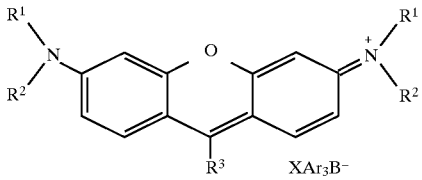 | Me | Me | H | | | | n-Bu | Ph |
| -B | | Me | Me | H | | | | n-Hex | Tol |
| -C | | Et | Et | H | | | | n-Bu | Tol |
| -D | | Et | Et | H | | | | n-Hex | Ph |
| -E | | Et | Et | H | | | | n-Oct | Ph |
| -F | | Me | Me | CN | | | | n-Hex | Ph |
| 31 | 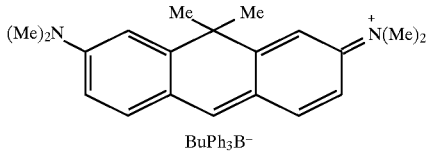 | | | | | | | | |

TABLE 1-continued

| Dye No. | Structure | $R^1$ | $R^2$ | $R^3$ | $R^4$ | $R^5$ | n | X | Ar |
|---|---|---|---|---|---|---|---|---|---|
| 32-A | 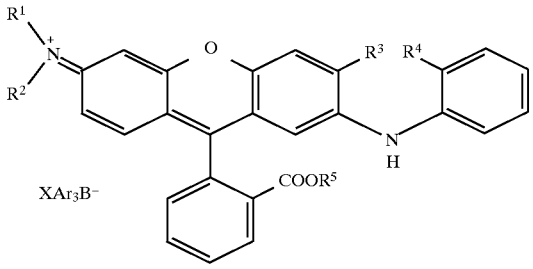 | c-Hex | Me | Me | H | Et | | n-Bu | Tol |
| -B | | c-Hex | Me | Me | H | All | | n-Hex | Anisyl |
| -C | | Et | Et | Me | H | Et | | n-Oct | Ph |
| -D | | Et | Et | H | Cl | All | | n-Bu | Tol |
| -E | | Et | Et | Cl | H | Bu | | n-Hex | Xylyl |
| -F | | Bu | Bu | H | Cl | Bu | | n-Oct | Ph |
| -G | | Tol | Et | Me | H | Bz | | n-Bu | Tol |
| 33-A | 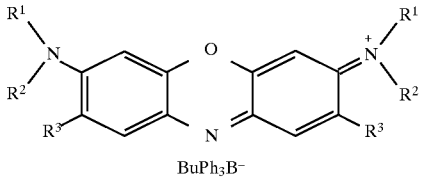 | Et | Et | H | | | | | |
| -B | | H | Et | Me | | | | | |
| 34-A | 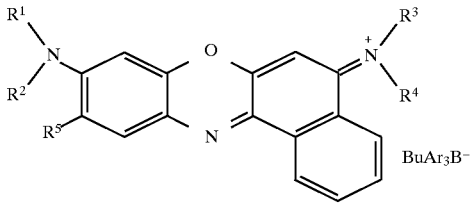 | H | H | H | H | H | | | Ph |
| -B | | H | Et | H | Et | H | | | Xylyl |
| -C | | Me | Me | Me | Me | H | | | Ph |
| -D | | H | Et | H | Et | Me | | | Tol |
| 35-A | 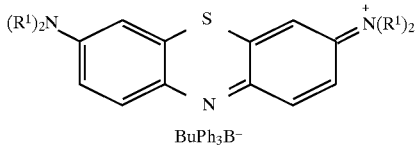 | H | | | | | | | |
| -B | | Me | | | | | | | |
| 36 | 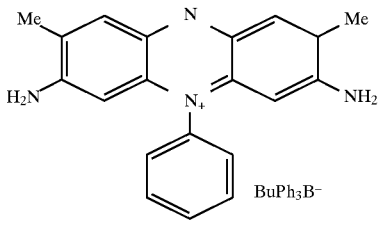 | | | | | | | | |
| 37-A | 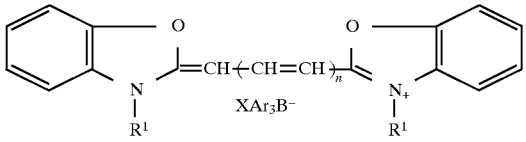 | Me | | | | | 0 | n-Hex | Ph |
| -B | | Et | | | | | 1 | n-Bu | Anisyl |
| -C | | n-Hex | | | | | 1 | n-Bu | Ph |
| -D | | n-Hex | | | | | 1 | n-Hex | Anisyl |
| -E | | n-Hex | | | | | 1 | n-Oct | Ph |
| -F | | Me | | | | | 2 | n-Bu | Tol |
| -G | | Et | | | | | 2 | n-Bu | Ph |
| -H | | Et | | | | | 2 | n-Hex | Xylyl |
| -I | | Et | | | | | 2 | n-Oct | Ph |
| -J | | Et | | | | | 3 | n-Bu | Ph |
| 38-A | 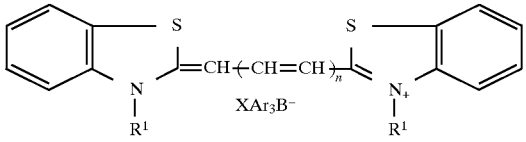 | Me | | | | | 0 | n-Hex | Ph |
| -B | | Et | | | | | 1 | Me | Anisyl |
| -C | | Et | | | | | 1 | n-Bu | Ph |
| -D | | n-Hep | | | | | 1 | n-Hex | Anisyl |
| -E | | Me | | | | | 2 | n-Bu | Ph |
| -F | | Me | | | | | 2 | Me | Tol |
| -G | | Et | | | | | 2 | n-Bu | Ph |
| -H | | Et | | | | | 2 | n-Hex | Anisyl |
| -I | | Et | | | | | 2 | n-Oct | Ph |
| -J | | Et | | | | | 3 | n-Bu | Ph |

TABLE 1-continued

| Dye No. | Structure | $R^1$ | $R^2$ | $R^3$ | $R^4$ | $R^5$ | n | X | Ar |
|---|---|---|---|---|---|---|---|---|---|
| 39-A | 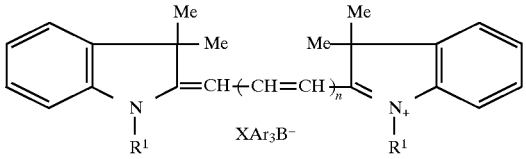 | Me | | | | | 0 | n-Bu | Ph |
| -B | | Me | | | | | 1 | n-Bu | Ph |
| -C | | Me | | | | | 1 | n-Hex | Anisyl |
| -D | | Me | | | | | 1 | n-Oct | Xylyl |
| -E | | n-Hep | | | | | 1 | n-Bu | Ph |
| -F | | Me | | | | | 2 | Me | Ph |
| -G | | Me | | | | | 2 | n-Bu | Tol |
| -H | | Me | | | | | 2 | n-Hex | Anisyl |
| -I | | n-Hep | | | | | 2 | n-Hex | Xylyl |
| -J | | Me | | | | | 3 | n-Bu | Ph |
| -K | | Me | | | | | 3 | n-Hex | Anisyl |
| -L | | Me | | | | | 3 | n-Oct | Ph |
| 40 | 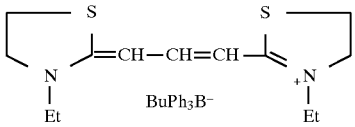 | | | | | | | | |
| 41-A | 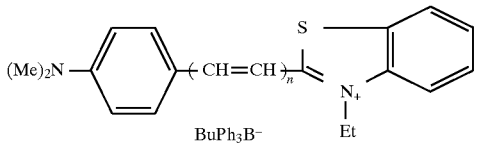 | | | | | | 1 | | |
| -B | | | | | | | 2 | | |
| 42-A | 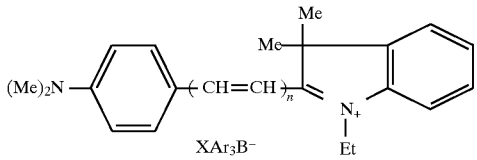 | | | | | | 1 | n-Bu | Ph |
| -B | | | | | | | 1 | n-Hex | Anisyl |
| -C | | | | | | | 2 | n-Bu | Tol |
| -D | | | | | | | 2 | n-Hex | Anisyl |
| -E | | | | | | | 2 | n-Oct | Ph |
| 43-A | 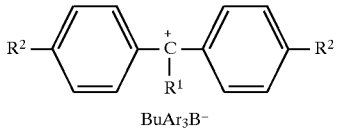 | H | $N(Me)_2$ | | | | | | Ph |
| -B | | Me | $N(Me)_2$ | | | | | | Ph |
| -C | | $NH_2$ | $N(Me)_2$ | | | | | | Anisyl |
| -D | | CN | $N(Me)_2$ | | | | | | Ph |
| -E | | Cl | $N(Me)_2$ | | | | | | Tol |
| -F | | COOH | H | | | | | | Ph |
| 44 | 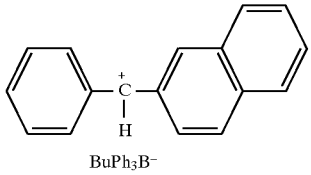 | | | | | | | | |
| 45 | 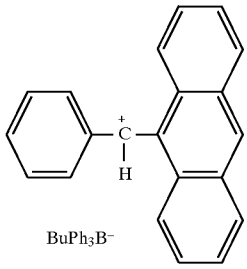 | | | | | | | | |
| 46-A | 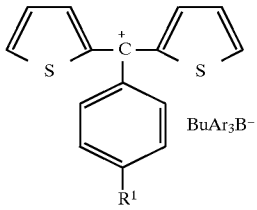 | H | | | | | | | Ph |
| -B | | $N(Me)_2$ | | | | | | | Ph |
| -C | | $N(Me)_2$ | | | | | | | Anisyl |

TABLE 1-continued
| Dye No. | Structure | $R^1$ | $R^2$ | $R^3$ | $R^4$ | $R^5$ | n | X | Ar |
|---|---|---|---|---|---|---|---|---|---|
| 47-A | 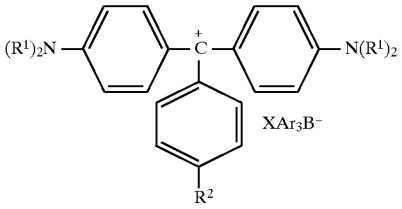 | Me | H | | | | | n-Bu | Ph |
| -B | | Et | OMe | | | | | n-Hex | Anisyl |
| -C | | Me | CN | | | | | n-Oct | Ph |
| -D | | Et | $N(Et)_2$ | | | | | n-Bu | Ph |
| -E | | Et | Cl | | | | | n-Hex | Anisyl |
| -F | | Me | $N(Me)_2$ | | | | | n-Bu | Tol |
| 48 | 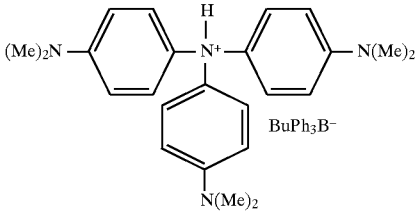 | | | | | | | | |
| 49 | 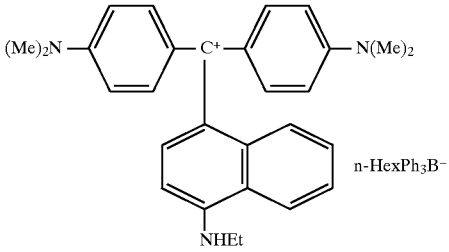 | | | | | | | | |
| 50 | 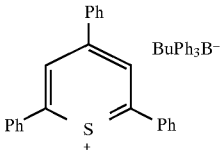 | | | | | | | | |
| 51-A | 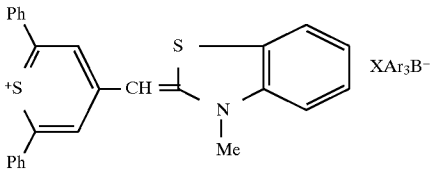 | | | | | | | n-Bu | Tol |
| -B | | | | | | | | n-Hex | Anisyl |
| -C | | | | | | | | n-Oct | Ph |
| 52-A | 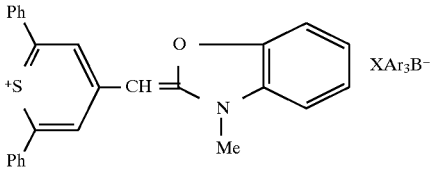 | | | | | | | n-Bu | Ph |
| -B | | | | | | | | n-Hex | Anisyl |
| -C | | | | | | | | n-Oct | Ph |
| 53-A | 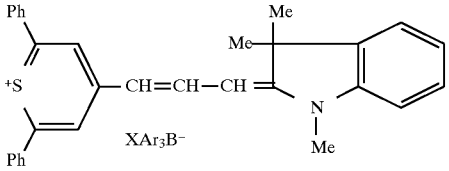 | | | | | | | n-Bu | Ph |
| -B | | | | | | | | n-Hex | Anisyl |
| -C | | | | | | | | n-Oct | Ph |

TABLE 1-continued
| Dye No. | Structure | $R^1$ | $R^2$ | $R^3$ | $R^4$ | $R^5$ | n | X | Ar |
|---|---|---|---|---|---|---|---|---|---|
| 54-A<br>-B<br>-C | 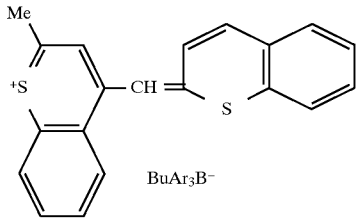 | | | | | | | | Ph<br>Anisyl<br>Ph |
TABLE 1-18
| Dye No. | Structure | R | Ar | λ max (TMPT) |
|---|---|---|---|---|
| 55 | 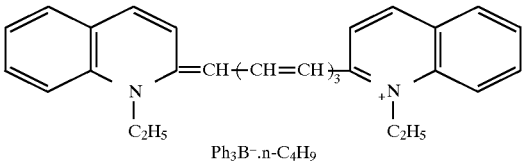 | | | 820 nm |
| 56 | 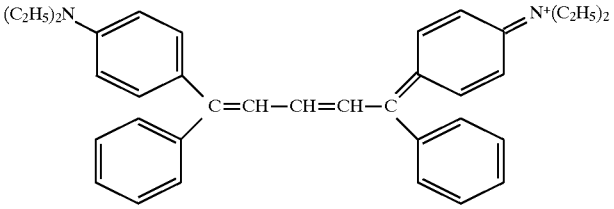 | | | 830 nm |
| 57-A<br>-B<br>-C | 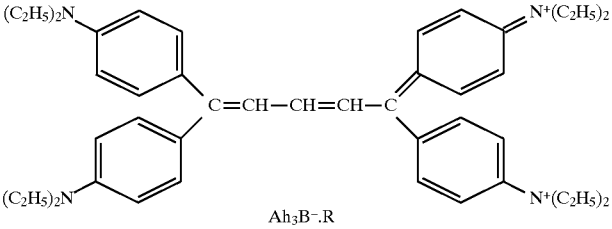 | n-Butyl<br>n-Hexyl<br>n-Octyl | Phenyl<br>Anisyl<br>Phenyl | 822 nm<br>822 nm<br>822 nm |
| 58 | 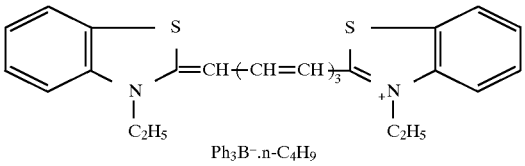 | | | 768 nm |
| 59-A<br>-B<br>-C | 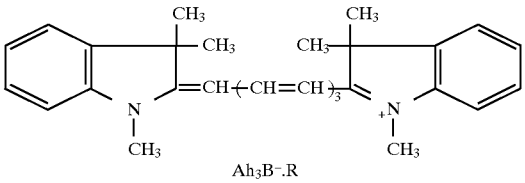 | n-Butyl<br>n-Hexyl<br>n-Octyl | Phenyl<br>Anisyl<br>Phenyl | 748 nm<br>748 nm<br>748 nm |

TABLE 1-18-continued

| Dye No. | Structure | R | Ar | λ max (TMPT) |
|---|---|---|---|---|
| 60-A | 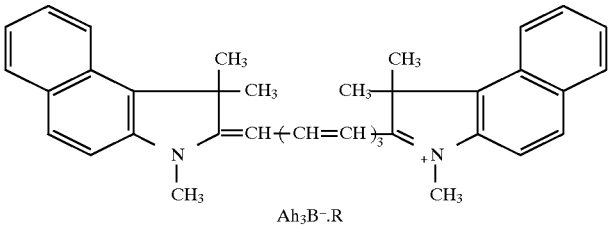 | n-Butyl | Phenyl | 785 nm |
| -B | | n-Hexyl | Anisyl | 785 nm |
| -C | | n-Octyl | Phenyl | 785 nm |
| 61-A | 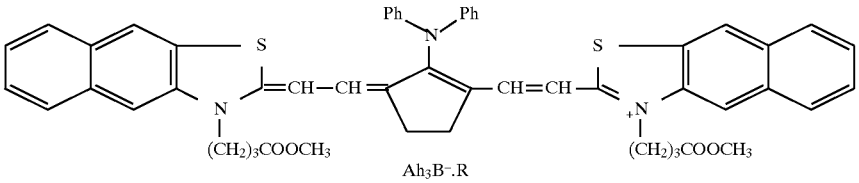 | n-Butyl | Phenyl | 828 nm |
| -B | | n-Hexyl | Anisyl | 828 nm |
| -C | | n-Octyl | Phenyl | 828 nm |
| 62 | 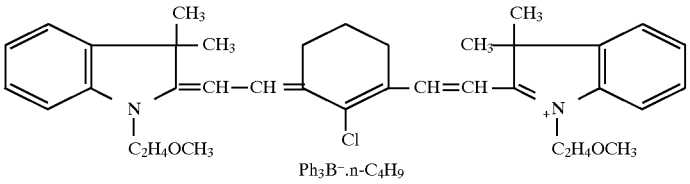 | | | 787 nm |
| 63 | 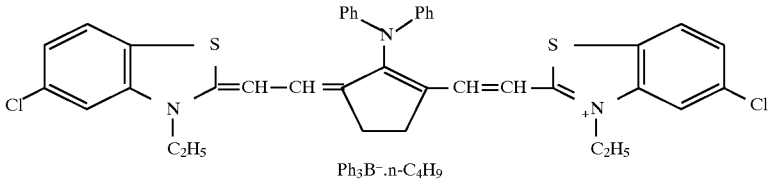 | | | 819 nm |
| 64 | 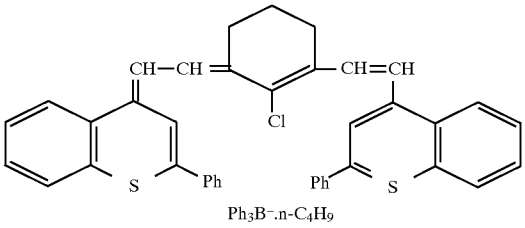 | | | 1080 nm |

(Cautions) λ represents a wavelength having absorption.
TMPT represents trimethylolpropane trimethacrylate.
Moreover, in Table 1,
(1) Me represents methyl group.
(2) Et represents ethyl group.
(3) n-Bu represents n-butyl group.
(4) n-Hex represents n-hexyl group.
(5) c-Hex represents cyclohexyl group.
(6) n-Hep represents n-heptyl group.
(7) n-Oct represents n-octyl group.
(8) Ar represents an aryl group.
(9) Ph represents phenyl group.
(10) Bz represents benzyl group.
(11) Tol represents toluyl group.
(12) Anisyl represents anisyl group.
(13) OMe represents methoxy group.
(14) Xylyl represents xylyl group.

The above visible ray-near infrared ray-absorbing dye is blended with the resin binder A.

It is desired that the amount of the above visible ray-near infrared ray-absorbing dye is not less than 0.01 part, particularly not less than 0.1 part per 100 parts of the total resin binders in order to impart sufficient coloration to an obtained decolorizable toner. Also, it is desired that the amount is not more than 25 parts, particularly not more than 15 parts per 100 parts of the total resin binders in order not to exert a bad influence upon the tribo-electrically charged amount which is intrinsic in an obtained decolorizable toner.

In the present invention, as typical examples of the decolorizing agent, for instance, a decolorizing agent represented by the general formula (III):

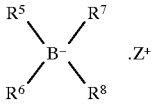

(III)

wherein each of $R^5$, $R^6$, $R^7$ and $R^8$ is independently an alkyl group, an aryl group, allyl group, an aralkyl group, an alkenyl group, an alkynyl group, silyl group, a heterocyclic group, a substituted alkyl group, a substituted aryl group, a substituted allyl group, a substituted aralkyl group, a substituted alkenyl group, a substituted alkynyl group or a substituted silyl group, $Z^+$ is a quaternary ammonium cation, a quaternary pyridinium cation, a quaternary quinolinium cation or a phosphonium cation is cited.

As concrete examples of the above decolorizing agent (borate compounds), there can be cited, for instance,
tetramethylammonium n-methyltriphenylborate,
tetramethylammonium n-butyltriphenylborate,
tetramethylammonium n-octyltriphenylborate,
tetramethylammonium n-dodecyltriphenylborate,
tetramethylammonium n-methyltri-p-tolylborate,
tetramethylammonium n-butyltri-p-tolylborate,
tetramethylammonium n-octyltri-p-tolylborate,
tetramethylammonium n-dodecyltri-p-tolylborate,
tetramethylammonium n-methyltrianisylborate,
tetramethylammonium n-butyltrianisylborate,
tetramethylammonium n-octyltrianisylborate,
tetramethylammonium n-dodecyltrianisylborate,
tetraethylammonium n-methyltriphenylborate,
tetraethylammonium n-butyltriphenylborate,
tetraethylammonium n-octyltriphenylborate,
tetraethylammonium n-dodecyltriphenylborate,
tetraethylammonium n-methyltri-p-tolylborate,
tetraethylammonium n-butyltri-p-tolylborate,
tetraethylammonium n-octyltri-p-tolylborate,
tetraethylammonium n-dodecyltri-p-tolylborate,
tetraethylammonium n-methyltrianisylborate,
tetraethylammonium n-butyltrianisylborate,
tetraethylammonium n-octyltrianisylborate,
tetraethylammonium n-dodecyltrianisylborate,
tetrabutylammonium n-methyltriphenylborate,
tetrabutylammonium n-butyltriphenylborate,
tetrabutylammonium n-octyltriphenylborate,
tetrabutylammonium n-dodecyltriphenylborate,
tetrabutylammonium n-methyltri-p-tolylborate,
tetrabutylammonium n-butyltri-p-tolylborate,
tetrabutylammonium n-octyltri-p-tolylborate,
tetrabutylammonium n-dodecyltri-p-tolylborate,
tetrabutylammonium n-methyltrianisylborate,
tetrabutylammonium n-butyltrianisylborate,
tetrabutylammonium n-octyltrianisylborate,
tetrabutylammonium n-dodecyltrianisylborate,
tetraoctylammonium n-methyltriphenylborate,
tetraoctylammonium n-butyltriphenylborate,
tetraoctylammonium n-octyltriphenylborate,
tetraoctylammonium n-dodecyltriphenylborate,
tetraoctylammonium n-methyltri-p-tolylborate,
tetraoctylammonium n-butyltri-p-tolylborate,
tetraoctylammonium n-octyltri-p-tolylborate,
tetraoctylammonium n-dodecyltri-p-tolylborate,
tetraoctylammonium n-methyltrianisylborate,
tetraoctylammonium n-butyltrianisylborate,
tetraoctylammonium n-octyltrianisylborate,
tetraoctylammonium n-dodecyltrianisylborate,
tetramethylammonium di-n-methyldiphenylborate,
tetramethylammonium di-n-butyldiphenylborate,
tetramethylammonium di-n-octyldiphenylborate,
tetramethylammonium di-n-dodecyldiphenylborate,
tetramethylammonium di-n-methyldi-p-tolylborate,
tetramethylammonium di-n-butyldi-p-tolylborate,
tetramethylammonium di-n-octyldi-p-tolylborate,
tetramethylammonium di-n-dodecyldi-p-tolylborate,
tetramethylammonium di-n-methyldianisylborate,
tetramethylammonium di-n-butyldianisylborate,
tetramethylammonium di-n-octyldianisylborate,
tetramethylammonium di-n-dodecyldianisylborate,
tetraethylammonium di-n-methyldiphenylborate,
tetraethylammonium di-n-butyldiphenylborate,
tetraethylammonium di-n-octyldiphenylborate,
tetraethylammonium di-n-dodecyldiphenylborate,
tetraethylammonium di-n-methyldi-p-tolylborate,
tetraethylammonium di-n-butyldi-p-tolylborate,
tetraethylammonium di-n-octyldi-p-tolylborate,
tetraethylammonium di-n-dodecyldi-p-tolylborate,
tetraethylammonium di-n-methyldianisylborate,
tetraethylammonium di-n-butyldianisylborate,
tetraethylammonium di-n-octyldianisylborate,
tetraethylammonium di-n-dodecyldianisylborate,
tetrabutylammonium di-n-methyldiphenylborate,
tetrabutylammonium di-n-butyldiphenylborate,
tetrabutylammonium di-n-octyldiphenylborate,
tetrabutylammonium di-n-dodecyldiphenylborate,
tetrabutylammonium di-n-methyldi-p-tolylborate,
tetrabutylammonium di-n-butyldi-p-tolylborate,
tetrabutylammonium di-n-octyldi-p-tolylborate,
tetrabutylammonium di-n-dodecyldi-p-tolylborate,
tetrabutylammonium di-n-methyldianisylborate,
tetrabutylammonium di-n-butyldianisylborate,
tetrabutylammonium di-n-octyldianisylborate,
tetrabutylammonium di-n-dodecyldianisylborate,
tetraoctylammonium di-n-methyldiphenylborate,
tetraoctylammonium di-n-butyldiphenylborate,
tetraoctylammonium di-n-octyldiphenylborate,
tetraoctylammonium di-n-dodecyldiphenylborate,
tetraoctylammonium di-n-methyldi-p-tolylborate,
tetraoctylammonium di-n-butyldi-p-tolylborate,
tetraoctylammonium di-n-octyldi-p-tolylborate,
tetraoctylammonium di-n-dodecyldi-p-tolylborate,
tetraoctylammonium di-n-methyldianisylborate,
tetraoctylammonium di-n-butyldianisylborate,
tetraoctylammonium di-n-octyldianisylborate,
tetraoctylammonium di-n-dodecyldianisylborate,
tetramethylammonium tetraphenylborate,
tetraethylammonium tetraphenylborate,
tetrabutylammonium tetraphenylborate,
tetraoctylammonium tetraphenylborate,
tetramethylammonium tetra-p-tolylborate,
tetraethylammonium tetra-p-tolylborate,
tetrabutylammonium tetra-p-tolylborate,
tetraoctylammonium tetra-p-tolylborate,
tetramethylammonium tetraanisylborate,
tetraethylammonium tetraanisylborate,
tetrabutylammonium tetraanisylborate,
tetraoctylammonium tetraanisylborate,
tetramethylammonium triphenylnaphtylborate,
tetraethylammonium triphenylnaphtylborate,
tetrabutylammonium triphenylnaphtylborate,
tetramethylammonium tri-p-tolylnaphtylborate,
tetraethylammonium tri-p-tolylnaphtylborate,
tetrabutylammonium tri-p-tolylnaphtylborate,
tetramethylammonium tetrabutylborate,
tetraethylammonium tetrabutylborate,
tetrabutylammonium tetrabutylborate,
trimethylhydrogenammonium n-butyltriphenylborate,
triethylhydrogenammonium n-butyltriphenylborate, trimethylhydrogenammonium n-butyltrianisylborate,
triethylhydrogenammonium n-butyltrianisylborate,
tetrahydrogenammonium n-butyltriphenylborate,
tetrahydrogenammonium n-butyltrianisylborate,
tetramethylammonium tri-n-butyl(triphenylsilyl)borate,
tetraethylammonium tri-n-butyl(triphenylsilyl)borate,
tetrabutylammonium tri-n-butyl(triphenylsilyl)borate,
tetramethylammonium tri-n-butyl(dimethylphenylsilyl) borate,
tetraethylammonium tri-n-butyl(dimethylphenylsilyl) borate,
tetrabutylammonium tri-n-butyl(dimethylphenylsilyl) borate,
tetramethylammonium n-octyldiphenyl(di-n-butylphenylsilyl)borate,
tetraethylammonium n-octyldiphenyl(di-n-butylphenylsilyl) borate,
tetrabutyl-ammonium n-octyldiphenyl(di-n-butylphenylsilyl)borate,
tetramethylammonium dimethylphenyl(trimethylsilyl) borate,
tetraethylammonium dimethylphenyl(trimethylsilyl)borate,
tetrabutylammonium dimethylphenyl(trimethylsilyl)borate,
methylpyridinium n-butyltriphenylborate,
methylpyridinium n-octyltriphenylborate,
methylpyridinium n-dodecyltriphenylborate,
ethylpyridinium n-butyltriphenylborate,
ethylpyridinium n-octyltriphenylborate,
ethylpyridinium n-dodecyltriphenylborate,
n-butylpyridinium n-butyltriphenylborate,
n-butylpyridinium n-octyltriphenylborate,
n-butylpyridinium n-dodecyltriphenylborate,
n-octylpyridinium n-butyltriphenylborate,
n-octylpyridinium n-octyltriphenylborate,
n-octylpyridinium n-dodecyltriphenylborate,
methylpyridinium n-butyltri-p-tolylborate,
methylpyridinium n-octyltri-p-tolylborate,
methylpyridinium n-dodecyltri-p-tolylborate,
ethylpyridinium n-butyltri-p-tolylborate,
ethylpyridinium n-octyltri-p-tolylborate,
ethylpyridinium n-dodecyltri-p-tolylborate,
n-butylpyridinium n-butyltri-p-tolylborate,
n-butylpyridinium n-octyltri-p-tolylborate,
n-butylpyridinium n-dodecyltri-p-tolylborate,
n-octylpyridinium n-butyltri-p-tolylborate,
n-octylpyridinium n-octyltri-p-tolylborate,
n-octylpyridinium n-dodecyltri-p-tolylborate,
methylpyridinium n-butyltrianisylborate,
methylpyridinium n-octyltrianisylborate,
methylpyridinium n-dodecyltrianisylborate,
ethylpyridinium n-butyltrianisylborate,
ethylpyridinium n-octyltrianisylborate,
ethylpyridinium n-dodecyltrianisylborate,
n-butylpyridinium n-butyltrianisylborate,
n-butylpyridinium n-octyltrianisylborate,
n-butylpyridinium n-dodecyltrianisylborate,
n-octylpyridinium n-butyltrianisylborate,
n-octylpyridinium n-octyltrianisylborate,
n-octylpyridinium n-dodecyltrianisylborate,
methylquinolinium n-butyltriphenylborate,
methylquinolinium n-octyltriphenylborate,
methylquinolinium n-dodecyltriphenylborate,
ethylquinolinium n-butyltriphenylborate,
ethylquino inium n-octyltriphenylborate,
ethylquinolinium n-dodecyltriphenylborate,
n-butylquinolinium n-butyltriphenylborate,
n-butylquinolinium n-octyltriphenylborate,
n-butylquinolinium n-dodecyltriphenylborate,
n-octylquinolinium n-butyltriphenylborate,
n-octylquinolinium n-octyltriphenylborate,
n-octylquinolinium n-dodecyltriphenylborate,
methylquinolinium n-butyltri-p-tolylborate,
methylquinolinium n-octyltri-p-tolylborate,
methylquinolinium n-dodecyltri-p-tolylborate,
ethylquinolinium n-butyltri-p-tolylborate,
ethylquinolinium n-octyltri-p-tolylborate,
ethylquinolinium n-dodecyltri-p-tolylborate,
n-butylquinolinium n-butyltri-p-tolylborate,
n-butylquinolinium n-octyltri-p-tolylborate,
n-butylquinolinium n-dodecyltri-p-tolylborate,
n-octylquinolinium n-butyltri-p-tolylborate,
n-octylquinolinium n-octyltri-p-tolylborate,
n-octylquinolinium n-dodecyltri-p-tolylborate,
methylquinolinium n-butyltrianisylborate,
methylquinolinium n-octyltrianisylborate,
methylquinolinium n-dodecyltrianisylborate,
ethylquinolinium n-butyltrianisylborate,
ethylquinolinium n-octyltrianisylborate,
ethylquinolinium n-dodecyltrianisylborate,
n-butylquinolinium n-butyltrianisylborate,
n-butylquinolinium n-octyltrianisylborate,
n-butylquinolinium n-dodecyltrianisylborate,
n-octylquinolinium n-butyltrianisylborate,
n-octylquinolinium n-octyltrianisylborate,
n-octylquinolinium n-dodecyltrianisylborate,
methylpyridinium di-n-butyldiphenylborate,
ethylpyridinium di-n-octyldiphenylborate,
n-butylpyridinium di-n-dodecyldiphenylborate,
n-octylpyridinium di-n-butyldiphenylborate,
methylpyridinium di-n-butyldi-p-tolylborate,
ethylpyridinium di-n-octyldi-p-tolylborate,
n-butylpyridinium di-n-dodecyldi-p-tolylborate,
n-octylpyridinium di-n-butyldi-p-tolylborate,
methylpyridinium di-n-butyldianisylborate,
ethylpyridinium di-n-octyldianisylborate,
n-butylpyridinium di-n-dodecyldianisylborate,
n-octylpyridinium di-n-butyldianisylborate,
methylquinolinium di-n-butyldiphenylborate,
ethylquinolinium di-n-octyldiphenylborate,
n-butylquinolinium di-n-dodecyldiphenylborate,
n-octylquinolinium di-n-butyldiphenylborate,
methylquinolinium di-n-butyldi-p-tolylborate,
ethylquinolinium di-n-octyldi-p-tolylborate,
n-butylquinolinium di-n-dodecyldi-p-tolylborate,
n-octylquinolinium di-n-butyldi-p-tolylborate,
methylquinolinium di-n-butyldianisylborate,
ethylquinolinium di-n-octyldianisylborate,
n-butylquinolinium di-n-dodecyldianisylborate,
n-octylquinolinium di-n-butyldianisylborate,
methylpyridinium tetra-n-butylborate,
ethylpyridinium tetra-n-butylborate,
n-butylpyridinium tetra-n-butylborate,
n-octylpyridinium tetra-n-butylborate,
methylquinolinium tetra-n-butylborate,
ethylquinolinium tetra-n-butylborate,
n-butylquinolinium tetra-n-butylborate,
n-octylquinolinium tetra-n-butylborate,
methylpyridinium tetra-n-octylborate,
ethylpyridinium tetra-n-octylborate,
n-butylpyridinium tetra-n-octylborate,
n-octylpyridinium tetra-n-octylborate,
methylquinolinium tetra-n-octylborate,
ethylquinolinium tetra-n-octylborate,
n-butylquinolinium tetra-n-octylborate, n-octylquinolinium tetra-n-octylborate,
tetramethylphosphonium n-butyltriphenylborate,
tetraethylphosphonium n-butyltriphenylborate,
tetra-n-butylphosphonium n-butyltriphenylborate,
tetra-n-octylphosphonium n-butyltriphenylborate,
tetramethylphosphonium n-butyltri-p-tolylborate,
tetraethylphosphonium n-butyltri-p-tolylborate,
tetra-n-butylphosphonium n-butyltri-p-tolylborate,
tetra-n-octylphosphonium n-butyltri-p-tolylborate,
tetramethylphosphonium n-butyltrianisylborate,
tetraethylphosphonium n-butyltrianisylborate,
tetra-n-butylphosphonium n-butyltrianisylborate,
tetra-n-octylphosphonium n-butyltrianisylborate,
tetramethylphosphonium n-octyltriphenylborate,
tetraethylphosphonium n-octyltriphenylborate,
tetra-n-butylphosphonium n-octyltriphenylborate,
tetra-n-octylphosphonium n-octyltriphenylborate,
tetramethylphosphonium n-octyltri-p-tolylborate,
tetraethylphosphonium n-octyltri-p-tolylborate,
tetra-n-butylphosphonium n-octyltri-p-tolylborate,
tetra-n-octylphosphonium n-octyltri-p-tolylborate,
tetramethylphosphonium n-octyltrianisylborate,
tetraethylphosphonium n-octyltrianisylborate,
tetra-n-butylphosphonium n-octyltrianisylborate,
tetra-n-octylphosphonium n-octyltrianisylborate,
tetramethylphosphonium n-dodecyltriphenylborate,
tetraethylphosphonium n-dodecyltriphenylborate,
tetra-n-butylphosphonium n-dodecyltriphenylborate,
tetra-n-octylphosphonium n-dodecyltriphenylborate,
tetramethylphosphonium n-dodecyltri-p-tolylborate,
tetraethylphosphonium n-dodecyltri-p-tolylborate,
tetra-n-butylphosphonium n-dodecyltri-p-tolylborate,
tetra-n-octylphosphonium n-dodecyltri-p-tolylborate,
tetramethylphosphonium n-dodecyltrianisylborate,
tetraethylphosphonium n-dodecyltrianisylborate,
tetra-n-butylphosphonium n-dodecyltrianisylborate,
tetra-n-octylphosphonium n-dodecyltrianisylborate,
tetramethylphosphonium di-n-butyldiphenylborate,
tetraethylphosphonium di-n-butyldiphenylborate,
tetra-n-butylphosphonium di-n-butyldiphenylborate,
tetra-n-octylphosphonium di-n-butyldiphenylborate,
tetramethylphosphonium di-n-butyldi-p-tolylborate,
tetraethylphosphonium di-n-butyldi-p-tolylborate,
tetra-n-butylphosphonium di-n-butyldi-p-tolylborate,
tetra-n-octylphosphonium di-n-butyldi-p-tolylborate,
tetramethylphosphonium di-n-butyldianisylborate,
tetraethylphosphonium di-n-butyldianisylborate,
tetra-n-butylphosphonium di-n-butyldianisylborate,
tetra-n-octylphosphonium di-n-butyldianisylborate,
tetramethylphosphonium di-n-octyldiphenylborate,
tetraethylphosphonium di-n-octyldiphenylborate,
tetra-n-butylphosphonium di-n-octyldiphenylborate,
tetra-n-octylphosphonium di-n-octyldiphenylborate,
tetramethylphosphonium di-n-octyldi-p-tolylborate,
tetraethylphosphonium di-n-octyldi-p-tolylborate,
tetra-n-butylphosphonium di-n-octyldi-p-tolylborate,
tetra-n-octylphosphonium di-n-octyldi-p-tolylborate,
tetramethylphosphonium di-n-octyldianisylborate,
tetraethylphosphonium di-n-octyldianisylborate,
tetra-n-butylphosphonium di-n-octyldianisylborate,
tetra-n-octylphosphonium di-n-octyldianislyborate,
tetraphenylphosphonium n-butyltriphenylborate,
tetraanisylphosphonium n-butyltriphenylborate,
tetraphenylphosphonium n-butyltri-p-tolylborate,
tetraanisylphosphonium n-butyltri-p-tolylborate,
tetraphenylphosphonium n-butyltrianisylborate,
tetraanisylphosphonium n-butyltrianisylborate,
tetraphenylphosphonium di-n-butyldiphenylborate,
tetraanisylphosphonium di-n-butyldiphenylborate,
tetraphenylphosphonium di-n-butyldi-p-tolylborate,
tetraanisylphosphonium di-n-butyldi-p-tolylborate,
tetraphenylphosphonium di-n-butyldianisylborate,
tetraanisylphosphonium di-n-butyldianisylborate, and the like. These decolorizing agents can be used alone or in an admixture thereof.

The above decolorizing agent is blended with at least one of the resin binder A and the resin binder B. In order to lower the contact frequency of the visible ray-near infrared ray-absorbing dye and the decolorizing agent and to avoid that the visible ray-near infrared ray-absorbing dye is discolored or faded, it is preferable that the decolorizing agent is blended with the resin binder B. Also, in order to prevent that the electrification characteristics of toner particles are lowered, it is preferable that the decolorizing agent is blended with the resin binder A.

It is desired that the amount of the above decolorizing agent is not less than 1 part, preferably not less than 5 parts per 100 parts of the above visible ray-near infrared ray-absorbing dye in order to increase the rate of decolorization, and is not more than 2500 parts, preferably 1000 parts per 100 parts of the above visible ray-near infrared ray-absorbing dye in order to improve light resistance of a figure or an image formed with the decolorizable toner and to avoid fading and decolorization.

It is desired that the amount of the decolorizing agent is not more than 500 parts, preferably not more than 300 parts per 100 parts of the resin binder A in order to uniformly disperse the decolorizing agent in the resin binder A when the decolorizing agent is blended with the resin binder A.

Also, it is desired that the amount of the decolorizing agent is not more than 100 parts, preferably not more than 50 parts per 100 parts of the resin binder B in order to uniformly disperse the decolorizing agent in the resin binder B when the decolorizing agent is blended with the resin binder B.

Also, it is desired that the amount of the decolorizing agent is not less than 0.01 part, preferably not less than 0.1 part per 100 parts of the total resin binders in order to impart sufficient decolorizing property to an obtained decolorizable toner, and that the amount is not more than 80 parts, preferably not more than 35 parts per 100 parts of the total resin binders in order not to exert a bad influence upon the tribo-electrically charged amount which is a characteristic of an obtained decolorizable toner.

In the present invention, when there is a necessity to adjust the electrically charged amount of an obtained decolorizable toner, a material having electrification property can be blended with the resin binder B. Among the materials having electrification property, a colorless, white or pale yellow, particularly a colorless or white material having electrification property, which does not damage the hue of a toner or the formed image of a toner after decolorization treatment, can be preferably used.

When the resin binder A and the resin binder B which are insoluble with each other are used as the resin binders, and the material having electrification property is blended with the resin binder B, since the resin binder A and the resin binder B are insoluble with each other, it is avoided that the visible ray-near infrared ray-absorbing dye and the decolorizing agent, which are blended with the resin binder A, and the material having electrification property are directly contacted, and the material having electrification property is not so affected by the strong positive electrification property of the visible ray-near infrared ray-absorbing dye.

Therefore, the tribo-electrically charged amount of an obtained decolorizable toner is easily adjusted. Furthermore, during the kneading in the production of a toner, at the same time that fading of the visible ray-near infrared ray-absorbing dye due to the material having electrification property is avoided, an obtained decolorizable toner becomes excellent in decolorizing property.

As typical examples of the above material having electrification property, for instance, an electric charge regulator and the like can be cited.

As the above electric charge regulator, for instance, electric charge regulators having a positive charge such as a quaternary ammonium salt, an alkylamide and a hydrophobic silica; electric charge regulators having a negative charge such as diaminoanthraquinone, a chlorinated polyolefin, a chlorinated polyester, a naphthenic acid metallic salt and a fatty acid metallic salt, and the like can be cited.

The above electric charge regulator is generally commercially available. As concrete examples of commodities thereof, there can be cited, for instance, BONTRON P-51 (made by ORIENT CHEMICAL INDUSTRIES, LTD.) and TP-415 (made by HODOGAYA CHEMICAL CO., LTD.) which are electric charge regulators of a quaternary ammonium salt having a positive charge, KAYACHARGE N-3 (made by NIPPON KAYAKU CO., LTD.) which is an electric charge regulator having a negative charge, BONTRON E-89 (made by ORIENT CHEMICAL INDUSTRIES, LTD.) which is an electric charge regulator having a negative charge of a carix arene, and the like.

The amount of the above material having electrification property may be properly adjusted to the electrically charged amount of an intended decolorizable toner. Moreover, it is preferable that the amount of the material having electrification property is not more than 20 parts, particularly not more than 8 parts per 100 parts of the total resin binders since there are tendencies that moisture resistance of an obtained decolorizable toner deteriorates and image stability becomes wrong when the amount of the material having electrification property is too large. Also, it is preferable that the amount of the above material having electrification property is not less than 0.3 part, particularly not less than 1 part per 100 parts of the total resin binders when a certain extent of the electrification property is imparted thereto.

When an agent for preventing fading is previously blended with the decolorizable toner of the present invention, deterioration of image density of a printed or copied image made of the decolorizable toner can be avoided. This is based upon the inhibition of reaction and decomposition of the visible ray-near infrared ray-absorbing dye contained in the decolorizable toner due to light and heat.

The agent for preventing fading used in the present invention exhibits a function for preventing that the visible ray-near infrared ray-absorbing dye is decolorized, discolored or faded, and in the present invention, at least one member selected from a heat-resistant age resistor, a metal oxide and a metal soap can be used. The reason why the agent for preventing fading used in the present invention exhibits such a function for preventing fading is not clear, however, may be thought to be originated in that a phenolic hydroxyl group exists in the heat-resistant age resistor, that a basic polar group exists on the surface of the metal oxide and also that an ionic polar group such as carboxyl group exists in the metal soap.

That is, it is thought that the visible ray-near infrared ray-absorbing dye used in the present invention is an ionic complex and an ion pair of a dye complex becomes stable by the existence of a polar group of the agent for preventing fading, so that the stability to light and heat of the visible ray-near infrared ray-absorbing dye increases. Accordingly, from this nature, it is thought that decolorization, discoloration and fading are avoided since the visible ray-near infrared ray-absorbing dye becomes stable when the above heat-resistant age resistor, the metal oxide or the metal soap exists together with the visible ray-near infrared ray-absorbing dye used in the present invention at the same time.

As concrete examples of the heat-resistant age resistor, there can be cited, for instance, hydroquinone derivative age resistors such as 2,5-di-t-amylhydroquinone, 2,5-di-t-butylhydroquinone and hydroquinone monoethyl ether; alkylated phenol and phenol derivative age resistors such as methyl p-hydroxybenzoate, ethyl p-hydroxylbenzoate, propyl p-hydroxylbenzoate, 2,2-bis(4-hydroxyphenyl)propane, bis (4-hydroxyphenyl)sulfone, 3,4-hydroxyphenyl-p-tolylsulfone, methyl gallate, ethyl gallate, stearyl gallate, n-propyl gallate, lauryl gallate, resorcinol, 1-oxy-3-methyl-4-isopropylbenzene, 2,6-di-t-butylphenol, 2,6-di-t-butyl-4-ethylphenol, 2,6-di-t-butyl-4-methylphenol, 2,6-di-t-butyl-4-sec-butylphenol, butylhydroxyanisole, 2,6-di-t-butyl-α-dimethylamino-p-cresol, 2-(1-methylcyclohexyl)-4,6-dimethylphenol, styrenated phenol and an alkylated phenol; hindered phenol age resistors such as 1,1,3-tris-(2-methyl-4-hydroxy-5-t-butylphenyl)butane, 4,4'-butylidenebis-(3-methyl-6-t-butylphenol), 2,2-thiobis(4-methyl-6-t-butylphenol) and n-octadecyl-3-(4'-hydroxy-3'-5'-di-t-butylphenyl)propionate; phosphite age resistors such as tris (nonylphenyl) phosphite, tris(mixed mono- and di-nonylphenyl) phosphite, phenyldiisodecyl phosphite, diphenylmono(2-ethylhexyl) phosphite, diphenylmonotridecyl phosphite, diphenylisodecyl phosphite, diphenylisooctyl phosphite, triphenyl phosphite, tris(tridecyl) phosphite and tetraphenyldipropylene glycol phosphite, and the like. These heat-resistant age resistors can be used alone or in an admixture thereof. Among these heat-resistant age resistors, methyl p-hydroxylbenzoate, propyl p-hydroxybenzoate, 2,2-bis(4-hydroxyphenyl)propane, bis(4-hydroxyphenyl) sulfone, 3,4-hydroxyphenyl-p-tolylsulfone, methyl gallate, ethyl gallate, stearyl gallate, n-propyl gallate, lauryl gallate, resorcinol and the like are preferable since they are excellent in transparency, whiteness and solubility to the resin binders.

The above heat-resistant age resistor may be blended with either the resin binder A or the resin binder B. However, in order to sufficiently impart fading resistance to the visible ray-near infrared ray-absorbing dye, it is preferable that the heat-resistant age resistor is blended with the resin binder A with which the visible ray-near infrared ray-absorbing dye is blended.

It is desired that the amount of the above heat-resistant age resistor is not less than 0.02 part, preferably not less than 0.3 part per 100 parts of the resin binder A in order to sufficiently exhibit fading resistance when the heat-resistant age resistor is blended with the resin binder A. Also, it is desired that the amount of the above heat-resistant age resistor is not more than 200 parts, preferably not more than 150 parts per 100 parts of the resin binder A in order to uniformly disperse the above heat-resistant age resistor in the resin binder A.

Moreover, it is desired that the amount of the above heat-resistant age resistor is not more than 10 parts, preferably not more than 7 parts per 100 parts of the total resin binders in order not to exert an influence upon the tribo-electrically charged amount of an obtained decolorizable toner.

As concrete examples of the metal oxide, there can be cited, for instance, MgO, $Al_2O_3$, $SiO_2$, $Na_2O$, $SiO_2$.MgO, $SiO_2.Al_2O_3$, $Al_2O_3.Na_2O.CO_2$, $MgO.Al_2O_3.CO_2$ and the like. These metal oxides can be used alone or in an admixture thereof. Among these metal oxides, MgO, a mixture of MgO and $SiO_2$, a mixture of MgO and $Al_2O_3$, $Na_2O$, $SiO_2.MgO$, $SiO_2.Al_2O_3$, $Al_2O_3$, $Na_2O.CO_2$, $MgO.Al_2O_3.CO_2$ and the like are preferable since they are particularly excellent in fading resistance.

The above metal oxide may be blended with either the resin binder A or the resin binder B. However, in order to sufficiently impart fading resistance to the visible ray-near infrared ray-absorbing dye, it is preferable that the metal oxide is blended with the resin binder A with which the visible ray-near infrared ray-absorbing dye is blended.

It is desired that the amount of the above metal oxide is not less than 1 part, preferably not less than 3 part per 100 parts of the resin binder A in order to sufficiently exhibit fading resistance when the metal oxide is blended with the resin binder A. Also, it is desired that the amount of the above metal oxide is not more than 300 parts, preferably not more than 150 parts per 100 parts of the resin binder A in order to uniformly disperse the above metal oxide in the resin binder A.

Moreover, it is desired that the amount of the above metal oxide is adjusted to not more than 30 parts, preferably not more than 15 parts per 100 parts of the total resin binders since there is a tendency that the color density of a printed matter is faded when the amount is too large.

By the way, when the amount of the above metal oxide is not less than 1 part per 100 parts of the total resin binders, in case an image is formed with the decolorizable toner on a white copying paper which is usually used in electrophotography, and then the image is decolorized by the irradiation of visible rays and/or near infrared rays, the decolorized portion of the image shows the same color and gloss as the copying paper since the gloss of a resin binder of its own is inhibited. Therefore, there is an advantage that the image-formed portions are hardly distinguished from the other portions after decolorizing. Among the above metal oxides, such advantage is particularly noticeable when a metal oxide containing MgO or $SiO_2$ is used. A metal oxide containing MgO, $SiO_2$ and MgO, a metal oxide containing $SiO_2$ and a mixture thereof and the like can be furthermore particularly preferably used in the present invention since they do not obstruct coloring of a decolorizable toner during printing or forming of an image.

Moreover, it is desired that the average particle diameter of the above metal oxide which is an agent for preventing fading is usually not more than 5 $\mu$m, particularly not more than 2 $\mu$m since quality of image is sometimes impaired when the average particle diameter is too large. Also, the shape and color of the particle are not particularly limited. However, it is desired that the shape of the particle is spherical or ellipsoidal in order to frost the gloss of the resin binder and vanish traces when a formed figure or image is decolorized, and that the color of the particle is white since the color of copying papers for electrophotography is generally white.

As concrete examples of the above metal soap, there can be cited, for instance, stearic acid salts such as lithium stearate, magnesium stearate, aluminum stearate, calcium stearate, strontium stearate, barium stearate, zinc stearate, cadmium stearate and lead stearate; lauric acid salts such as cadmium laurate, zinc laurate, calcium laurate and barium laurate; chlorostearic acid salts such as calcium chlorostearate, barium chlorostearate and cadmium chlorostearate; 2-ethylhexanoic acid salts such as barium 2-ethylhexanoate, zinc 2-ethylhexanoate, cadmium 2-ethylhexanoate and lead 2-ethylhexanoate; ricinoleic acid salts such as barium ricinoleate, zinc ricinoleate and cadmium ricinoleate; a dibasic lead stearate such as a formula: $2PbO.Pb(C_{17}H_{35}COO)_2$; salicylic acid salts such as lead salicylate, zinc salicylate, tin salicylate and chromium salicylate; a tribasic lead maleate such as a formula: $3PbO.Pb(C_8H_4O_4)H_2O$; a dibasic lead phthalate such as a formula: $2PbO.Pb(C_8H_4O_4)$; and the like. These metal soaps can be used alone or in an admixture thereof. Among these metal soaps, zinc stearate, calcium stearate, magnesium stearate, zinc laurate, lead salicylate, zinc ricinoleate, barium ricinioleate, barium 2-ethylhexanoate, and the like are preferable because they have whiteness and a melting point which is suitable for the toner, and the like.

The above metal soap may be blended with either the resin binder A or the resin binder B. However, in order to sifficiently impart fading resistance to the visible ray-near infrared ray-absorbing dye, it is desired that the metal soap is blended with the resin binder A with which the visible ray-near infrared ray-absorbing dye is blended.

It is desired that the amount of the metal soap is not less than 0.05 part, preferably not less than 0.1 part per 100 parts of the resin binder A in order to sufficiently exhibit fading resistance when the metal soap is blended with the resin binder A. Also, it is desired that the amount of the above soap is not more than 200 parts, preferably not more than 150 parts per 100 parts of the resin binder A in order to uniformly disperse the above metal soap in the resin binder A.

Moreover, it is desired that the amount of the metal soap is not more than 10 parts, preferably not more than 5 parts per 100 parts of the total resin binders used in the decolorizable toner in order to avoid bleeding on the surface of the decolorizable toner without imparting a bad influence to the tribo-electrically charged amount of the decolorizable toner. It is known that the dispersibility of a white filler becomes good when a dispersing agent is added thereto, and after decolorizing, the whiteness of an image based upon the above decolorizable toner is improved in some cases.

As occasion demands, a white filler may be blended with the decolorizable toner of the present invention as an auxiliary component for decolorization, which is an agent for imparting characteristics of a toner. As concrete examples of the white filler, there can be cited, for instance, titanium oxide, calcium carbonate, alumina, zinc flower, magnesium oxide, magnesium hydroxide, clay, fine powder of silica, and the like. These white fillers can be used alone or in an admixture thereof. Among these white fillers, titanium oxide, calcium carbonate, zinc flower and the like are preferable since they are excellent in colorability.

It is desired that the amount of the above white filler is not less than 0.2 part, more preferably not more than 1 part per 100 parts of the total resin binders in order to exhibit an effect for blending the white filler. Since there is a tendency that the color density which is intrinsic to a toner is faded when the amount of the white filler is too large, it is desired that the amount is adjusted to not more than 50 parts, preferably not more than 30 parts per 100 parts of the total resin binders.

Also, in the present invention, as occasion demands, a violet ray-absorbing agent, a plasticizer, a lubricant or the like may be properly blended with the decolorizable toner alone or in an admixture thereof as an agent for imparting characteristics to a toner.

As concrete examples of the above lubricant, there can be cited, for instance, silicone oil, vegetable oil, animal oil, process oil, and the like. It is desired that the amount of the above lubricant is not less than 0.01 part, more preferably not less than 0.03 part per 100 parts of the total resin binders used in the decolorizable toner in order to sufficiently exhibit an effect for blending the lubricant therewith. Since there is a tendency that a bad influence is exerted upon the quality of image of a toner when the amount of the lubricant is too large, it is desired that the amount is not more than 2 parts, preferably not more than 0.5 part per 100 parts of the total resin binders used in the decolorizable toner.

These additives may be blended or kneaded at the same time during kneading of a dye composition. However, in order to sufficiently disperse and/or dissolve them, it is desired that these additives are previously blended or kneaded with the resin binder B.

As mentioned above, the decolorizable toner of the present invention contains the visible ray-near infrared ray-absorbing dye, the decolorizing agent and the resin binder as main components, which can be produced by, for instance, the process invention I, the process invention II and the like.

Both of the resin binder A containing the visible ray-near infrared ray-absorbing dye and the decolorizing agent, which is used in the above process invention I, and the resin binder A containing the visible ray-near infrared ray-absorbing dye, which is used in the above process invention II, can be prepared by a solution method.

When the decolorizable toner is produced by not using the resin binder A containing at least the visible ray-near infrared ray-absorbing dye, which is obtained by the solution process but using the resin binder containing at least the visible ray-near infrared ray-absorbing dye, which is obtained by a heating and kneading method, the toner has to be heated to not less than the softening point of the resin binder B. Therefore, since the visible ray-near infrared ray-absorbing dye is decomposed due to its heat, fading or discoloring cannot be avoided. However, according to the process of the present invention, its temperature increases only up to the boiling point of an organic solvent under reduced pressure. Therefore, the above-mentioned problem such as decomposition of the dye due to heat can be solved.

Also, when the cationic dye represented by the general formula (II) is used as the visible ray-near infrared ray-absorbing dye, the cationic dye is reacted with the decolorizing agent represented by the general formula (III) and exhibits decolorization property via the cationic dye represented by the general formula (I), and sufficient ion exchange thereof is carried out in an organic solvent.

Also, by dissolving the above visible ray-near infrared ray-absorbing dye and the decolorizing agent in an organic solvent, it becomes possible that they can be dispersed to a molecular lebel and its reaction probability is improved during decolorizing.

Accordingly, from the above viewpoint, a resin binder which is soluble or swelling, preferably soluble in an organic solvent is desired as the above resin binder A.

As to the agent for preventing fading which is added to a toner in order to inhibit fading when irradiating with natural light during its storage, it is preferable that the agent for preventing fading is used by dissolving or dispersing in the resin bidner A which has been dissolved in an organic solvent, and the agent for preventing fading which does not show sufficient solubility at a temperature in the vicinity of the softening point of the resin binder A can be particularly preferable. Since excessive shearing force is necessitated for such an agent for preventing fading in order to disperse the agent for preventing fading during its kneading, its temperature increases due to the shearing force and the decomposition of the visible ray-near infrared ray-absorbing dye is sometimes promoted. Therefore, it is desired that the agent for preventing fading is dissolved or dispersed in an organic solvent.

It is desired that the boiling point of the above organic solvent is not more than the decomposition temperature of the visible ray-near infrared ray-absorbing dye under 1 atm. Hereupon, when the boiling point of the organic solvent is excessively higher than the decomposition temperature of the visible ray-near infrared ray-absorbing dye, removal of the solvent under reduced pressure becomes difficult and the decomposition of the visible ray-near infrared ray-absorbing dye is generated.

As concrete examples of the above organic solvent, there can be cited, for instance, alcohol solvents such as methanol, ethanol, isopropanol and butanol; ketone solvents such as acetone, methyl ethyl ketone and methyl isobutyl ketone; a nitrile solvent such as acetonitrile; ester solvents such as ethyl acetate and butyl acetate; ether solvents such as diethyl ether, tetrahydrofuran, dimethoxyethane and anisole; an amide solvent such as dimethylformamide; an amine solvent such as triethylamine; aromatic solvents such as benzene, toluene, xylene and chlorobenzene; halogenated hydrocarbon solvents such as dichloromethane, chloroform, carbon tatrachloride, dichloroethane, trichloroethane, tetrachloroethane, trichlene and perchlene, and the like. Among them, acetone, methyl ethyl ketone, methanol, ethanol, acetonitrile, tetrahydrofuran, benzene, toluene, xylene, dichloromethane, chloroform, dichloroethane and the like are preferable. Moreover, these organic solvents can be used not only alone but also as a mixed solvent thereof.

It is desired that the amount of the organic solvent is usually not less than 10 parts, preferably not less than 20 parts per 100 parts of the resin bidner in order to sufficiently dissolve the visible ray-near infrared ray-absorbing dye therein. Also, it is desired that the amount is usually not more than 5000 parts, preferably not more than 3000 parts per 100 parts of the resin binder in order not to spend excessive cost for removing the organic solvent.

Moreover, as to a prepared solution of the dye composition, there is no necessity to dissolve the agent for preventing fading in the organic solvent and the agent for preventing fading may have been dispersed in a pulverized state.

In the process invention I, for instance, a dried product is obtained by dissolving the visible ray-near infrared ray-absorbing dye, the decolorizing agent and the resin binder A in the organic solvent, blending or kneading them, as occasion demands, adding thereto the wax, the additive and the like, blending or kneading them and removing the organic solvent from an obtained mixture.

Also, in the process invention II, for instance, a dried product is obtained by dissolving the visible ray-near infrared ray-absorbing dye and the resin binder A in the organic solvent, blending or kneading them, as occasion demands, adding thereto the wax, the additive and the like, blending or kneading them, and removing the organic solvent from an obtained mixture.

The dried product obtained in the process invention I or the process invention II can be used as it is. However, the dried product may be coarsely pulverized with, for instance, a hammer mill, a cutter mill or the like and then finely pulverized with, for instance, a jet mill or the like.

In the process invention I and the process invention II, the decolorizable toner is obtained by heating to melt and kneading the above dried product, the resin binder B, and as occasion demands, the decolorizing agent, the additive or the like, thereafter cooling them, coarsely pulverizing an obtained mass with, for instance, a hammer mill, a cutter mill or the like, then finely pulverizing them with, for instance, a jet mill to the extent of 5 to 30 μm in average particle diameter and, as occasion demands, classifying them.

Moreover, as the above resin binder B, a resin binder whose softening point is not so low is desired in consideration of offset resistance.

As to melting and kneading, there are cited ① a method for melting and kneading at a time the above dried product and the resin binder B, and as occasion demands, the decolorizing agent, the additive or the like with an extruder, a kneader, a roll or the like, ② a method for heating to melt and kneading the resin binder B, and as occasion demands, the decolorizing agent, the additive or the like with an extruder, supplying the above dried product in the middle of the extruder with a constant-volume- or constant-weight-feeder or the like and furthermore heating to melt and kneading them, ③ a method for heating to melt and kneading the resin binder B, and as occasion demands, the decolorizing agent, the additive or the like then adding the above dried product thereto and furthermore heating to melt and kneading them, ④ a method for heating to melt and kneading the resin binder B, and as occasion demands, the decolorizing agent, the additive or the like, and thereafter melting and kneading the obtained molten kneaded mixture and the above dried product with a kneader which is different from a kneader with which the above resin binder B has been kneaded, and the like. In the above method of ④, the used two kneaders may be the same or different.

In kneading of the above dried product and the resin binder B, and as occasion demands, the decolorizing agent, the additive or the like, it is not limited to the above methods, and the decolorizable toner can be also obtained, for instance, by dissolving or dispersing these components in a solvent, blending them, removing the solvent therefrom and thereafter pulverizing.

After the decolorizable toner of the present invention is printed and fixed on an image-supporting substrate made of paper or the like, the printed portion can be decolorized by irradiating with visible rays to near infrared rays by means of a semiconductor laser, a halogen lamp, a light emitting diode or the like. After decolorizing the printed portion, further printing can be repeatedly carried out on the decolorized portion.

Accordingly, the decolorizable toner of the present invention can be preferably used for printing, for instance, on a passenger ticket, which can be repeatedly used by printing at the time of taking a train and erasing at the time of getting off, a coupon ticket and various pieces of paper for admission ticket as well as an image-supporting substrate.

Next, the decolorizable toner and its process for preparing of the present invention are more specifically explained on the basis of examples. However, the present invention is not limited to only the examples.

PREPARATION EXAMPLES OF DYE COMPOSITION FOR DECOLORIZABLE TONER (PREPARATION EXAMPLE NOS. MB-1 to 14)

Raw materials shown in Tables 2 to 3 were dissolved or dispersed in the blending ratios shown in Table 4. The obtained uniformly mixed solution was dried by heating by means of a vacuum heating drier (made by OKAWARA MFG. Co., LTD., VB-101) and cooled. The obtained dried mixture was pulverized with a cutter mill to give a dye composition.

Examples 1 to 22

Raw materials shown in Table 2 and the dye compositions for a decolorizable toner obtained in Preparation Example NOS. MB-1 to 14 were uniformly blended together in the ratios shown in Table 5 by means of a blender, then heated to melt and kneaded by means of a biaxial kneading extruder (made by IKEGAI CORP., PCM-30) and cooled to give a mass.

The obtained mass was pulverized with a cutter mill and a jet mill, and thereafter classified by means of a wind-force classifier to give a decolorizable toner having a particle diameter of 5 to 20 μm.

Next, 0.4 part by weight of a finely powdered silica (made by HOECHST JAPAN LIMITED, HVK-2150) was uniformly blended with 100 parts by weight of the obtained decolorizable toner by means of a blender to give a mixture.

Five parts by weight of this mixture and 95 parts by weight of a silicone resin-coated FERRITE CARRIER (made by POWDERTECH CO., LTD., F95-100) were uniformly blended together by means of a V-type blender to give a two-component type developer.

The obtained two-component type developer was set in a copying machine (made by Ricoh Company, Ltd., FT-4525) which has been on the market and copied on a black solid as a manuscript. The reflection density of the obtained duplicated printed matter X1 was measured at 20 points by means of a Macbeth densitometer and its average was employed as x1.

Then, the duplicated printed matter was set in a tray for paper again, and copied and printed again so that an image was superposed thereon, that is, a toner layer was superposed thereon. The reflection density of the obtained duplicated printed matter X2 was measured in accordance with the above method and its average was employed as x2.

In case of $|x2-x1| \leqq 0.05$, the duplicated printed matter X2 was used as an image sample for evaluation.

In case of $|x2-x1| \geqq 0.05$, the aforementioned recopying procedure was repeated, and the reflection density xi of a copied and printed image Xi was compared with the reflection density xi−1 which had been measured the last time. The above procedure was repeated so that $|xi-xi-1| \leqq 0.05$ was satisfied, and the duplicated printed matter Xi was used as an image sample for evaluation. Using this image sample for evaluation, as physical properties of the decolorizable toner, image stability and decolorizing property were examined in accordance with the following methods. Moreover, the decomposition percentage of a colored dye contained in the obtained decolorizable toner was also examined in accordance with the following method.

(Image stability)

The reflection density of the image sample for evaluation of the obtained decolorizable toner was measured as a density A by means of a Macbeth densitometer. After the same sample was allowed to stand for 24 hours on an irradiated surface having 1500 lux under a fluorescent lamp, the reflection density was measured as a density B in the same manner as the above, and retention was calculated in accordance with the equation:

$$(\text{Retention})=(\text{Density B})/(\text{Density A})\times 100$$

and image stability was evaluated in accordance with the following criteria for evaluation.

(Criteria for evaluation)

A: Retention was not less than 80%.

B: Retention was not less than 61% and less than 80%.

C: Retention was not less than 41% and less than 60%.

D: Retention was less than 41%.

(Decolorizing property)

The image sample for evaluation of the obtained decolorizable toner was allowed to stand in a constant-temperature bath, atmospheric temperature of which was 60° C., while irradiating with light by means of a halogen lamp. Using a double ends-type halogen lamp (made by Usio Inc., QRZ 85-400 BANFI) as the halogen lamp, its voltage was adjusted to 85 V and its color temperature was adjusted to 3190 K. The halogen lamp was set up at a distance of 10 cm from the surface of the image sample for evaluation in the constant-temperature bath.

The image sample for evaluation was allowed to stand for not less than 3 minutes and the halogen lamp was turned on for a predetermined period of time. The reflection density of the light-irradiated matter was measured as a density C by means of a Macbeth densitometer. When satisfying the condition of the density $C \leqq 0.15$, the decolorizable toner was judged to be decolorized. Hereupon, the predetermined period of time was set as 10, 20, 30 or 60 seconds.

(Criteria for evaluation)

A: The toner was decolorized when the period of time for turning the lamp on was within 10 seconds.

B: The toner is decolorized when the period of time for turning the lamp on is within 20 seconds, however, the toner is not decolorized when the period of time is within 10 seconds.

C: The toner is decolorized when the period of time for turning the lamp on is within 30 seconds, however, the toner is not decolorized when the period of time is within 20 seconds.

D: The toner is decolorized when the period of time for turning the lamp on is within 60 seconds, however, the toner is not decolorized when the period of time is within 30 seconds.

E: The toner is not decolorized even when the period of time for turning the lamp on is within 60 seconds.

(Decomposition percentage of colored dye)

The obtained decolorizable toner was extracted with acetonitrile and the concentration of a colored dye contained in the decolorizable toner was measured by means of liquid chromatography (HPLC). The concentration of the colored dye obtained by the extraction from the decolorizable toner was employed as a concentration E, the concentration of the colored dye added to the decolorizable toner was employed as a concentration D and the decomposition percentage of the colored dye during the production of the decolorizable toner was measured in accordance with the equation:

$$(\text{Decomposition percentage}) = ((\text{Concentration D}) - (\text{Concentration E}))/(\text{Concentration D}) \times 100$$

(Criteria for evaluation)

A: The decomposition percentage was less than 5%.

B: The decomposition percentage was not less than 5% and less than 15%.

C: The decomposition percentage was not less than 15% and less than 30%.

D: The decomposition percentage was not less than 30%

Comparative Examples 1 to 10

Raw materials shown in Tables 2 to 3 were uniformly blended together in the blending ratios shown in Table 6 by means of a blender, thereafter heated to melt and kneaded by means of a biaxial kneading extruder (made by IKEGAI CORP., PCM-30) and cooled to give a mass.

The obtained mass was pulverized by means of a cutter mill and a jet mill and thereafter classified by means of a wind-force classifier to give a decolorizable toner having a particle diameter of 5 to 20 $\mu$m.

The physical properties of the obtained decolorizable toner were examined in accordance with the same methods as in Examples 1 to 22. The results are shown in Table 6.

TABLE 2

| Raw material | Name | Contents |
|---|---|---|
| Adhesive resin | RE-1 | Styrene-butyl acrylate-butyl methacrylate copolymer (made by MITSUI TOATSU CHEMICALS, INC., CRP-200) |
| | RE-2 | Styrene-butyl acrylate-methyl methacrylate copolymer (made by SANYO CHEMICAL INDUSTRIES, LTD., UNI-3000) |
| | RE-3 | Polyester resin (made by Kao Corporation, NE-1100) |
| | RE-4 | Polymethyl methacrylate resin (made by Sumitomo Chemical Company, Limited, SUMIPEX B LG-6) |
| | RE-5 | Styrene-butyl methacrylate-methyl methacrylate copolymer (made by MITSUI TOATSU CHEMICALS, INC., XPA-4527) |
| | RE-6 | Polyester resin (made by TOYOBO CO., LTD., VYLON RV-200) |
| Decolorizing agent | SE-1 | Tetrabutylammonium n-butyltriphenylborate |
| | SE-2 | Tetrabutylammonium n-butyltri-p-tolylborate |
| | SE-3 | Methylpyridinium n-butyltrianisylborate |
| | SE-4 | Tetraphenylphosphonium n-hexyltriphenylborate |
| Agent for preventing fading | AO-1 | 2,2-Bis(4-hydroxyphenyl)propane (made by NICCA CHEMICAL CO., LTD.) |
| | AO-2 | 3,4-Dihydroxyphenyl-p-tolylsulfone (made by SHOWA DENKO K. K., CD-180) |
| | AO-3 | Zinc stearate (made by Sakai Chemical Industry Co., Ltd., SZ# 2000) |
| | AO-4 | Magnesium oxide (made by KYOWA CHEMICAL INDUSTRY CO., LTD., KYOWA MAG 150) |
| Agent for preventing offset | WA-1 | Polypropylene wax (made by SANYO CHEMICAL INDUSTRIES, LTD., VISCOL 660-P) |
| | WA-2 | Oxygenated polypropylene wax (made by SANYO CHEMICAL INDUSTRIES, LTD., VISCOL TS-200) |
| Filler | TW-1 | Titanium white |

TABLE 2-continued

| Raw material | Name | Contents |
|---|---|---|
| | | (made by ISHIHARA SANGYO KAISHA, LTD., CR-60) |
| | TW-1 | Silica gel |
| | | (made by FUJI DAVISON CHEMICAL LTD., SYLOPHOBIC 200) |
| Electric | CC-1 | BONTORON P-51 |
| charge | | (made by ORIENT CHEMICAL INDUSTRIES, LTD.) |
| regulator | CC-2 | KAYACHARGE N-1 |
| | | (made by NIPPON KAYAKU CO., LTD.) |
| Organic | SL-1 | Acetone |
| Solvent | SL-2 | Dichloromethane |

TABLE 3

| Raw material | Name | Contents |
|---|---|---|
| Dye | DY-1 | 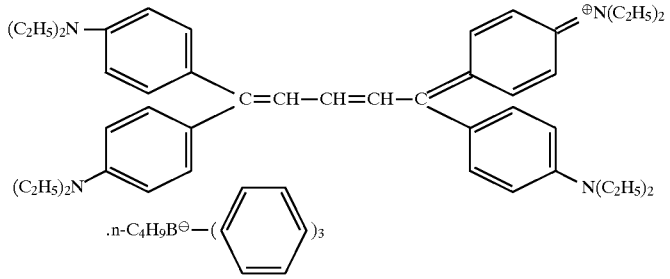 |
| | DY-2 | 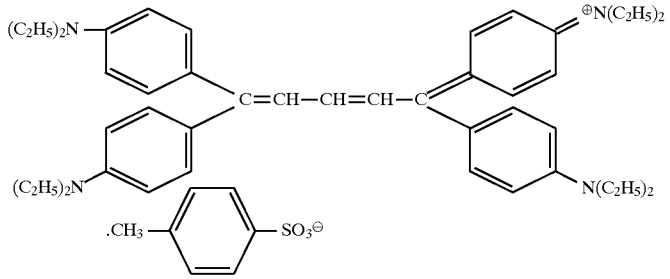 |
| | DY-3 | 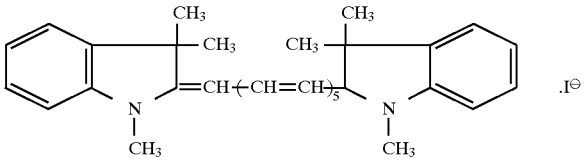 |
| | DY-4 | 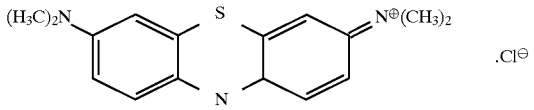 |
| | DY-5 | 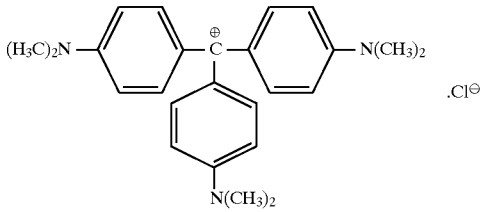 |

TABLE 3-continued

| Raw material | Name | Contents |
|---|---|---|
| | DY-6 | 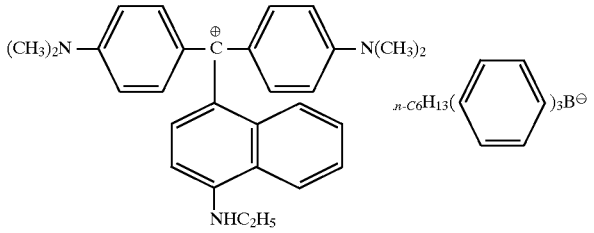 |

TABLE 4

| Preparation Example No. | Constituents of coating composition (parts by weight) | | | | |
|---|---|---|---|---|---|
| | Resin binder | Dye | Decolorizing agent | Agent for preventing fading | Organic solvent |
| MB-1 | RE-1 (10) | DY-1 (1) | SE-1 (0.5) | AO-1 (1) | SL-1 (30) |
| MB-2 | RE-2 (10) | DY-2 (2) | SE-2 (5) | AO-2 (0.5) | SL-1 (30) |
| MB-3 | RE-3 (10) | DY-2 (2) | SE-3 (5) | AO-3 (1) | SL-2 (30) |
| MB-4 | RE-4 (10) | DY-3 (2) | SE-4 (3) | — | SL-1 (30) |
| MB-5 | RE-5 (10) | DY-4 (1) | SE-1 (2) | AO-1 (0.5) | SL-1 (30) |
| MB-6 | RE-3 (10) | DY-4 (2) | SE-2 (10) | AO-3 (0.5) | SL-2 (30) |
| MB-7 | RE-4 (10) | DY-5 (2) | SE-3 (8) | — | SL-1 (30) |
| MB-8 | RE-6 (10) | DY-5 (2) | SE-4 (5) | AO-4 (1) | SL-2 (30) |
| MB-9 | RE-3 (10) | DY-6 (2) | SE-1 (3) | AO-1 (0.2) | SL-1 (30) |
| MB-10 | RE-4 (10) | DY-6 (1) | SE-1 (1) | AO-2 (0.1) | SL-1 (30) |
| MB-11 | RE-6 (10) | DY-4 (2) | SE-2 (10) | AO-1 (1) | SL-2 (30) |
| MB-12 | RE-6 (10) | DY-5 (2) | SE-3 (0.5) | — | SL-1 (30) |
| MB-13 | RE-1 (10) | DY-6 (2) | — | AO-2 (2) | SL-2 (30) |
| MB-14 | RE-4 (10) | DY-2 (1) | — | AO-4 (5) | SL-2 (30) |

TABLE 5

| Ex. No. | Constituents of decolorizable toner (parts by weight) | | | | | | Properties of decolorizable toner | | |
|---|---|---|---|---|---|---|---|---|---|
| | Resin binder | Preparation Ex. of dye composition | De-colorizing agent | Agent for preventing fading | Agent for preventing offset | Filler | Image stability | Decolorizing property | Fading resistance (decomposition percentage of colored dye) |
| 1 | RE-3 (90) | MB-1 (10) | — | AO-3 (0.3) | WA-1 (3) | TW-1 (5) | A | A | A |
| 2 | RE-3 (80) | MB-2 (20) | — | — | WA-1 (5) | TW-1 (5) | A | A | A |
| 3 | RE-1 (90) | MB-3 (10) | — | AO-2 (0.2) | WA-1 (5) | TW-1 (5) | A | A | A |
| 4 | RE-2 (80) | MB-4 (20) | SE-1 (0.3) | — | WA-1 (5) | TW-1 (5) | A | A | B |
| 5 | RE-5 (90) | MB-5 (10) | — | — | WA-1 (5) | TW-1 (5) | A | A | A |
| 6 | RE-5 (90) | MB-6 (10) | — | — | WA-2 (5) | TW-1 (5) | A | A | A |
| 7 | RE-1 (70) | MB-7 (30) | SE-2 (7) | AO-1 (1) | WA-1 (5) | TW-2 (5) | A | A | A |
| 8 | RE-3 (90) | MB-8 (10) | — | — | WA-1 (5) | TW-1 (5) | A | A | A |
| 9 | RE-1 (90) | MB-9 (10) | — | AO-4 (2) | WA-2 (5) | TW-1 (5) | A | A | A |
| 10 | RE-1 (80) | MB-10 (20) | SE-1 (10) | AO-2 (1) | WA-2 (3) | TW-1 (5) | A | A | A |
| 11 | RE-2 (90) | MB-11 (10) | — | AO-3 (0.3) | WA-2 (3) | TW-1 (5) | A | A | A |
| 12 | RE-5 (90) | MB-12 (10) | — | — | WA-1 (5) | TW-1 (5) | A | A | A |
| 13 | RE-1 (80) | MB-13 (20) | SE-2 (8) | — | WA-1 (5) | TW-1 (5) | A | B | A |
| 14 | RE-5 (90) | MB-14 (10) | SE-1 (3) | AO-1 (2) | WA-1 (5) | TW-1 (5) | A | B | A |
| 15 | RE-3 (90) | MB-3 (10) | — | — | WA-2 (5) | TW-2 (5) | A | A | A |
| 16 | RE-2 (70) | MB-4 (30) | — | — | WA-1 (5) | TW-2 (5) | A | A | B |
| 17 | RE-2 (90) | MB-8 (10) | SE-3 (0.5) | — | WA-1 (5) | TW-1 (5) | A | A | A |
| 18 | RE-1 (90) | MB-5 (10) | — | — | WA-1 (5) | TW-1 (5) | A | A | A |
| 19 | RE-1 (90) | MB-1 (10) | SE-4 (1) | — | WA-1 (5) | TW-1 (5) | B | A | A |
| 20 | RE-1 (90) | MB-11 (10) | — | — | WA-1 (5) | TW-2 (5) | A | A | A |
| 21 | RE-1 (90) | MB-12 (10) | — | AO-4 (5) | WA-1 (5) | TW-1 (5) | A | A | A |
| 22 | RE-3 (90) | MB-13 (10) | SE-1 (5) | AO-2 (0.5) | WA-1 (5) | TW-1 (5) | A | A | A |

TABLE 6

| Com. Ex. No. | Constituents of decolorizable toner (parts by weight) | | | | | | Properties of decolorizable toner | | |
|---|---|---|---|---|---|---|---|---|---|
| | Resin binder | Colored dye | De-colorizing agent | Agent for preventing fading | Agent for preventing offset | Filler | Image stability | Decolorizing property | Fading resistance (decomposition percentage of colored dye) |
| 1 | RE-1 (50) RE-5 (45) | DY-1 (2) | SE-1 (3) | AO-1 (1) | WA-1 (5) | WA-1 (5) | C | B | D |
| 2 | RE-2 (95) | DY-2 (2) | SE-2 (5) | AO-2 (1) | WA-1 (5) | WA-1 (5) | B | C | D |
| 3 | RE-1 (70) RE-3 (25) | DY-3 (2) | SE-3 (5) | — | WA-1 (5) | WA-1 (5) | A | E | B |
| 4 | RE-1 (95) | DY-4 (1) | SE-4 (10) | AO-1 (0.5) | WA-1 (5) | WA-1 (5) | B | C | B |
| 5 | RE-3 (95) | DY-5 (2) | SE-1 (8) | AO-3 (0.5) | WA-1 (5) | WA-1 (5) | B | E | B |
| 6 | RE-1 (95) | DY-1 (2) | SE-1 (5) | — | WA-1 (5) | WA-1 (5) | D | B | D |
| 7 | RE-2 (85) RE-4 (10) | DY-6 (2) | SE-2 (8) | AO-4 (2) | WA-1 (5) | WA-1 (5) | B | D | B |
| 8 | RE-5 (65) RE-6 (30) | DY-4 (2) | SE-3 (3) | AO-1 (1) | WA-1 (5) | WA-1 (5) | B | D | C |
| 9 | RE-5 (95) | DY-1 (2) | SE-1 (5) | AO-2 (1) | WA-1 (5) | WA-1 (5) | B | B | D |
| 10 | RE-3 (95) | DY-5 (2) | SE-2 (2) | — | WA-1 (5) | WA-1 (5) | A | D | B |

From the results shown in Table 5, it is understood that each of the decolorizable toners obtained by the methods of Examples 1 to 22 is excellent in image stability and decolorizing property, and the decomposition percentage of the colored dye is small.

From the above results, it is understood that according to the process for preparing the decolorizable toner of the present invention, there is obtained a decolorizable toner in which contained is the dye being decomposed a little even when heated during its kneading, on which a bad influence such as decolorization or fading is hardly exerted even when irradiated with natural light during its storage, and which can be easily decolorized when trying decolorizing.

Examples 23 to 27

To 20 parts by weight of toluene, 20 parts by weight of RE-7 shown in Table 7 as the resin binder, 2.5 parts by weight of DY-1 shown in Table 3 as the dye and 3.5 parts by weight of SE-1 shown in Table 2 as the decolorizing agent were added, they were stirred, dissolved and adjusted to give a uniform composition, and thereafter, the resulting composition was dried to give a dried product.

Next, using 80 parts by weight of RE-11 shown in Table 7 as the resin binder, 3 parts by weight of WA-3 shown in Table 7 as the wax and the amount shown in Table 8 of CC-1 shown in Table 2 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a decolorizable toner having positive electrification property and an average particle diameter of about 10 $\mu$m.

TABLE 7

| Raw material | Name | Contents |
|---|---|---|
| Resin binder | RE-7 | Polyester resin (softening point: 120° C. glass transition point: 70° C. acid value 28.6 mg/KOH) |
| | RE-8 | Polyester resin (softening point: 124° C. glass transition point: 71° C. acid value 12.6 mg/KOH) |
| | RE-9 | Polyester resin (softening point: 121° C. glass transition point: 68° C. acid value 6.4 mg/KOH) |
| | RE-10 | Polyester resin (softening point: 128° C. glass transition point: 67° C. acid value 4.2 mg/KOH) |
| | RE-11 | Styrene-butyl acrylate copolymer (softening point: 128° C. glass transition point: 65° C.) |
| | RE-12 | Styrene-butyl acrylate-methyl methacrylate copolymer (softening point: 110° C. glass transition point: 62° C.) |
| Wax | WA-3 | Polypropylene wax (VISCOL 550P (made by SANYO CHEMICAL INDUSTRIES, LTD.) |
| Electric charge regulator | CC-3 | TP-415 (made by HODOGAYA CHEMICAL CO., LTD.) |
| | CC-4 | KAYACHARGE N-3 (made by NIPPON KAYAKU CO., LTD.) |
| | CC-5 | BONTRON E-89 (made by ORIENT CHEMICAL INDUSTRIES, LTD.) |

After the obtained decolorizable toner was blended with an iron powder carrier (made by POWDERTECH CO., LTD., Z-200B) for 5 minutes, so that the concentration of the toner was 5% by weight to prepare a developer, the electrically charged amount of the decolorizable toner was examined by a blow-off method. The results are shown in Table 8.

TABLE 8

| Ex. No. | Amount of electric charge regulator (parts by weight) | Electrically charged amount (μC/g) |
|---|---|---|
| 23 | 1 | +2.4 |
| 24 | 3 | +4.7 |
| 25 | 5 | +6.5 |
| 26 | 10 | +10.8 |
| 27 | 0 | +1.3 |

Next, on the basis of the results described in Table 8, the relation between the amount of the electric charge regulator and the electrically charged amount was examined. The results are shown as A in FIG. 1.

Comparative Examples 11 to 15

Using 20 parts by weight of RE-7 and 80 parts by weight of RE-10 shown in Table 7 as the resin binders, 3 parts by weight of WA-3 shown in Table 7 as the wax, 2.5 parts by weight of DY-1 shown in Table 3 as the dye, 3.5 parts by weight of SE-1 shown in Table 2 as the decolorizing agent and the amount shown in Table 9 of CC-1 shown in Table 2 as the electric charge regulator, they were heated to 130° C. and molten and kneaded. Then, the obtained kneaded mixture was cooled, and thereafter pulverized to give a decolorizable toner having positive electrification property and an average particle diameter of about 10 μm.

Using the obtained decolorizable toner, a developer was prepared in the same manner as in Examples 23 to 27 and thereafter the electrically charged amount of the decolorizable toner was examined. The results are shown in Table 9.

TABLE 9

| Com. Ex. No. | Amount of electric charge regulator (parts by weight) | Electrically charged amount (μC/g) |
|---|---|---|
| 11 | 1 | +14.3 |
| 12 | 3 | +15.2 |
| 13 | 5 | +15.6 |
| 14 | 10 | +15.8 |
| 15 | 0 | +13.5 |

Next, on the basis of the results described in Table 9, the relation between the amount of the electric charge regulator and the electrically charged amount was examined. The results are shown as B in FIG. 1.

From the results shown in FIG. 1, it is understood that according to the methods in Examples 23 to 27 (A in FIG. 1), the electrically charged amount of the obtained decolorizable toners can be easily adjusted to a predetermined value by adjusting the amount of the electric charge regulator.

To the contrary, it is understood that according to the methods in Comparative Examples 11 to 15 (B in FIG. 1), adjusting the electrically charged amount of the obtained decolorizable toners to a predetermined value is difficult by adjusting the amount of the electric charge regulator.

Examples 28 to 31

To 20 parts by weight of toluene, 20 parts by weight of RE-7 shown in Table 7 as the resin binder, 2.5 parts by weight of DY-1 shown in Table 3 as the dye and 3.5 parts by weight of SE-1 shown in Table 2 as the decolorizing agent were added, they were stirred, dissolved and adjusted to give a uniform composition, and thereafter, the resulting composition was dried to give a dried product.

Next, using 80 parts by weight of RE-11 shown in Table 7 as the resin binder, 3 parts by weight of WA-3 shown in Table 7 as the wax and the amount shown in Table 10 of CC-5 shown in Table 7 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a decolorizable toner having negative electrification property and an average particle diameter of about 10 μm.

After the obtained decolorizable toner was blended with an iron powder carrier (made by POWDERTECH CO., LTD., Z-200B) for 5 minutes, so that the concentration of the toner was 5% by weight to prepare a developer, the electrically charged amount of the decolorizable toner was examined by a blow-off method. The results are shown in Table 10.

TABLE 10

| Ex. No. | Amount of electric charge regulator (parts by weight) | Electrically charged amount (μC/g) |
|---|---|---|
| 28 | 1 | −5.1 |
| 29 | 3 | −15.4 |
| 30 | 5 | −19.8 |
| 31 | 10 | −38.0 |

Next, on the basis of the results described in Table 10, the relation between the amount of the electric charge regulator and the electrically charged amount was examined. The results are shown as A in FIG. 2.

Comparative Examples 16 to 19

Using 20 parts by weight of RE-7 and 80 parts by weight of RE-11 shown in Table 7 as the resin binders, 3 parts by weight of WA-3 shown in Table 7 as the wax, 2.5 parts by weight of DY-1 shown in Table 3 as the dye, 3.5 parts by weight of SE-1 shown in Table 2 as the decolorizing agent and the amount shown in Table 11 of CC-5 shown in Table 7 as the electric charge regulator, they were heated to 130° C. and molten and kneaded. Then, the obtained kneaded mixture was cooled, and thereafter pulverized to give a visible ray-near infrared ray-decolorizable toner having an average particle diameter of about 10 μm.

Using the obtained decolorizable toner, a developer was prepared in the same manner as in Examples 28 to 31 and thereafter the electrically charged amount of the decolorizable toner was examined. The results are shown in Table 11.

TABLE 11

| Com. Ex. No. | Amount of electric charge regulator (parts by weight) | Electrically charged amount (μC/g) |
|---|---|---|
| 16 | 1 | +4.1 |
| 17 | 3 | +5.4 |

TABLE 11-continued

| Com. Ex. No. | Amount of electric charge regulator (parts by weight) | Electrically charged amount ($\mu$C/g) |
|---|---|---|
| 18 | 5 | +1.9 |
| 19 | 10 | −2.1 |

Next, on the basis of the results described in Table 11, the relation between the amount of the electric charge regulator and the electrically charged amount was examined. The results are shown as B in FIG. 2.

Figure 2:
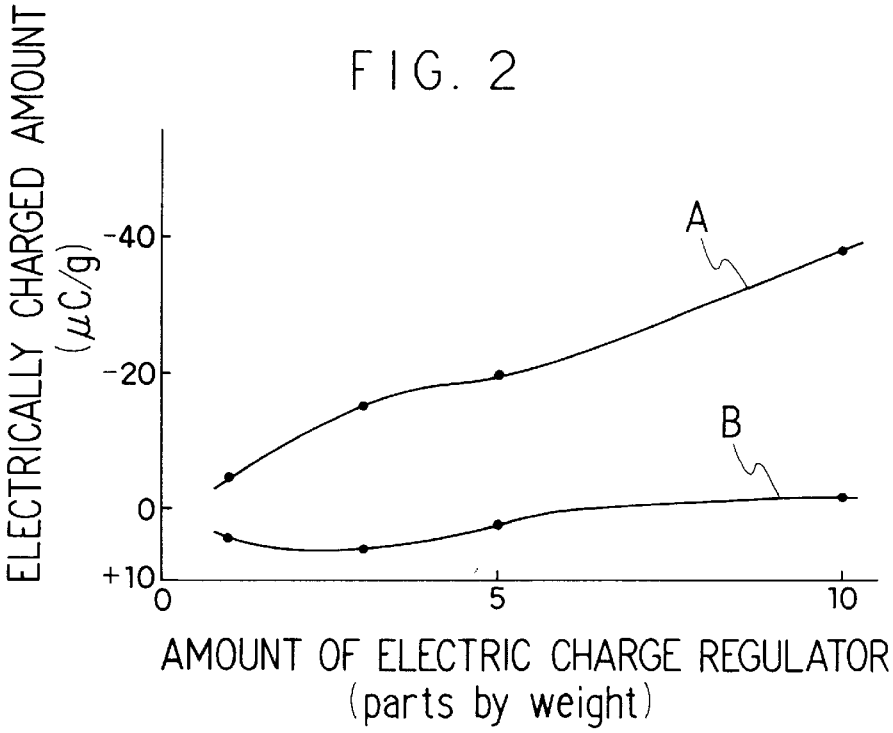
FIG. 2 is a graph showing the relation between the amount of the electric charge regulator and the electrically charged amount of the decolorizable toners obtained in Examples 28 to 31 and Comparative Examples 16 to 19.

From the results shown in FIG. 2, it is understood that according to the methods in Examples 28 to 31 (A in FIG. 2), the electrically charged amount of the obtained decolorizable toners can be easily adjusted to a predetermined value by adjusting the amount of the electric charge regulator.

To the contrary, it is understood that according to the methods in Comparative Examples 16 to 19 (B in FIG. 2), adjusting the electrically charged amount of the obtained decolorizable toners to a predetermined value is difficult by adjusting the amount of the electric charge regulator.

Example 32

To 20 parts by weight of toluene, 20 parts by weight of RE-7 shown in Table 7 as the resin binder, 2.5 parts by weight of DY-1 shown in Table 3 as the dye and 3.5 parts by weight of SE-1 shown in Table 2 as the decolorizing agent were added, they were stirred, dissolved and adjusted to give a uniform composition, and thereafter, the resulting composition was dried to give a dried product.

Next, using 80 parts by weight of RE-11 shown in Table 7 as the resin binder, 3 parts by weight of WA-3 shown in Table 7 as the wax and 3 parts by weight of CC-1 shown in Table 2 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a decolorizable toner having positive electrification property and an average particle diameter of about 10 $\mu$m.

The obtained decolorizable toner was blended with a silicone resin-coated FERRITE CARRIER (made by POWDERTECH CO., LTD., F97-2535) for 5 minutes, so that the concentration of the toner was 5% by weight to prepare a developer. Then, when the electrically charged amount of the decolorizable toner was examined by a blow-off method, the electrically charged amount was +9.8 $\mu$C/g.

Next, the obtained developer was set in a copying machine (made by Ricoh Company, Ltd., FT-4525) which has been on the market and copied on a black solid as a manuscript. The reflection density of the obtained duplicated printed matter X1 was measured at 20 points by means of a Macbeth densitometer and its average was employed as x1.

Then, the duplicated printed matter was set in a tray for papers again and copied and printed again so that an image was superposed thereon, that is, a toner layer was superposed thereon. The reflection density of the obtained duplicated printed matter X2 was measured in accordance with the above method and its average was employed as x2.

In case of $|x2-x1| \leqq 0.05$, the duplicated printed matter X2 was used as an image sample for evaluation.

In case of $|x2-x1| \geqq 0.05$, the aforementioned recopying procedure was repeated, and the reflection density xi of a copied and printed image Xi was compared with the reflection density xi−1 which had been measured the last time. The above procedure was repeated so that $|xi-xi-1| \leqq 0.05$ was satisfied, and the duplicated printed matter xi was used as an image sample for evaluation. Using this image sample for evaluation, as physical properties of the decolorizable toner, image stability was examined in the same manner as in Examples 1 to 22, and decolorizing property and fogging density were examined in accordance with the following methods. The results are shown in Table 12.

(1) Decolorizing property

The image sample for evaluation of the obtained decolorizable toner was allowed to stand in a constant-temperature bath, atmospheric temperature of which was 60° C., while irradiating with light by means of a halogen lamp. Using a double ends-type halogen lamp (made by Ushio Inc., QRZ 85-400 BANFI) as the halogen lamp, its voltage was adjusted to 85 V and its color temperature was adjusted to 3190 K. The halogen lamp was set up at a distance of 10 cm from the surface of the image sample for evaluation in the constant-temperature bath.

The image sample for evaluation was allowed to stand for not less than 3 minutes and the halogen lamp was turned on for a predetermined period of time. The reflection density of the light-irradiated matter was measured as a density C by means of a Macbeth densitometer. When satisfying the condition of the density $C \leqq 0.15$, the decolorizable toner was judged to be decolorized. Hereupon, the predetermined period of time was set as 10, 20, 30 or 60 seconds.

(Criteria for evaluation)

A: The toner was decolorized when the period of time for turning the lamp on was within 10 seconds.

B: The toner is decolorized when the period of time for turning the lamp on is within 20 seconds, however, the toner is not decolorized when the period of time is within 10 seconds.

C: The toner is decolorized when the period of time for turning the lamp on is within 30 seconds, however, the toner is not decolorized when the period of time is within 20 seconds.

D: The toner is decolorized when the period of time for turning the lamp on is within 60 seconds, however, the toner is not decolorized when the period of time is within 30 seconds.

E: The toner is not decolorized even when the period of time for turning the lamp on is within 60 seconds.

(2) Fogging density

An image sample of the decolorizable toner was produced using a white image as a manuscript, and the image density of the surface was measured by means of a reflectometer (made by NIPPON DENSHOKU KOGYO CO., LTD., TC-6DS type). Also, besides this, the image density of the surface of a sheet of non-duplicated paper was similarly measured. The value obtained by subtracting the value on the non-duplicated paper from the value on the obtained sample was employed as a fogging density. It is judged that the more the density approaches 0, the less the fogging density is.

Also, when decolorizing property was examined by irradiating the obtained duplicated printed matter with visible rays to near infrared rays, it was ascertained that there was no remained color or the like and that the toner was completely decolorized.

Example 33

To 20 parts by weight of toluene, 20 parts by weight of RE-8 shown in Table 7 as the resin binder, 2.5 parts by weight of DY-5 shown in Table 3 as the dye and 3.5 parts by weight of SE-2 shown in Table 2 as the decolorizing agent were added, they were stirred, dissolved and adjusted to give a uniform composition, and thereafter, the resulting composition was dried to give a dried product.

Next, using 80 parts by weight of RE-12 shown in Table 7 as the resin binder, 3 parts by weight of WA-3 shown in Table 7 as the wax and 3 parts by weight of CC-3 shown in Table 7 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a decolorizable toner having positive electrification property and an average particle diameter of about 10 μm.

The obtained decolorizable toner was blended with a silicone resin-coated FERRITE CARRIER (made by POWDERTECH CO., LTD., F97-2535) for 5 minutes, so that the concentration of the toner was 5% by weight to prepare a developer. Then, when the electrically charged amount of the decolorizable toner was examined by a blow-off method, the electrically charged amount was +8.6 μC/g.

Next, using the obtained developer, image stability, decolorizing property and fogging density were examined in the same manner as in Example 32. The results are shown in Table 12.

Also, when decolorizing property was examined by irradiating the obtained duplicated printed matter with visible rays to near infrared rays, it was ascertained that there was no remained color or the like, and the toner was completely decolorized.

Example 34

To 20 parts by weight of toluene, 20 parts by weight of RE-7 shown in Table 7 as the resin binder, 2.5 parts by weight of DY-1 shown in Table 3 as the dye and 3.5 parts by weight of SE-1 shown in Table 2 as the decolorizing agent were added, they were stirred, dissolved and adjusted to give a uniform composition, and thereafter, the resulting composition was dried to give a dried product.

Next, using 80 parts by weight of RE-11 shown in Table 7 as the resin binder, 3 parts by weight of WA-3 shown in Table 7 as the wax and 3 parts by weight of CC-4 shown in Table 7 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a decolorizable toner having an average particle diameter of about 10 μm.

The obtained decolorizable toner was blended with a FERRITE CARRIER (made by KANTO DENKA KOGYO CO., LTD., FB-810), so that the concentration of the toner was 5% by weight. The resulting mixture was blended for 5 minutes, so that the mixture was a uniform composition to prepare a developer. Then, when the electrically charged amount of the decolorizable toner was examined by a blow-off method, the electrically charged amount was −15.6 μC/g.

Next, using the obtained developer, image stability, decolorizing property and fogging density were examined in the same manner as in Example 32 except that the applied voltage was adjusted. The results are shown in Table 12.

Also, when decolorizing property was examined by irradiating the obtained duplicated printed matter with visible rays to near infrared rays, it was ascertained that there was no remained color or the like and the toner was completely decolorized.

Example 35

To 20 parts by weight of toluene, 20 parts by weight of RE-7 shown in Table 7 as the resin binder, 2.5 parts by weight of DY-5 shown in Table 3 as the dye and 3.5 parts by weight of SE-1 shown in Table 2 as the decolorizing agent were added, they were stirred; dissolved and adjusted to give a uniform composition, and thereafter, the resulting composition was dried to give a dried product.

Next, using 80 parts by weight of RE-11 shown in Table 7 as the resin binder, 3 parts by weight of WA-3 shown in Table 7 as the wax and 3 parts by weight of CC-5 shown in Table 7 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a decolorizable toner having an average particle diameter of about 10 μm.

The obtained decolorizable toner was blended with a FERRITE CARRIER (made by KANTO DENKA KOGYO CO., LTD., FB-810), so that the concentration of the toner was 5% by weight. The resulting mixture was blended for 5 minutes, so that the mixture was a uniform composition to prepare a developer. Then, when the electrically charged amount of the decolorizable toner was examined by a blow-off method, the electrically charged amount was −16.3 μC/g.

Next, using the obtained developer, image stability, decolorizing property and fogging density were examined in the same manner as in Example 32 except that the applied voltage was adjusted. The results are shown in Table 12.

Also, when decolorizing property was examined by irradiating the obtained duplicated printed matter with visible rays to near infrared rays, it was ascertained that there was no remained color or the like and the toner was completely decolorized.

Example 36

To 20 parts by weight of toluene, 20 parts by weight of RE-8 shown in Table 7 as the resin binder, 2.0 parts by weight of DY-1 shown in Table 3 as the dye and 3.5 parts by weight of SE-2 shown in Table 2 as the decolorizing agent were added, they were stirred, dissolved and adjusted to give a uniform composition, and thereafter, the resulting composition was dried to give a dried product.

Next, using 80 parts by weight of RE-8 shown in Table 7 as the resin binder, 3 parts by weight of WA-3 shown in Table 7 as the wax and 3 parts by weight of CC-1 shown in Table 2 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a decolorizable toner having an average particle diameter of about 10 μm.

The obtained decolorizable toner was blended with a silicone resin-coated FERRITE CARRIER (made by POWDERTECH CO., LTD., F97-2535), so that the concentration of the toner was 5% by weight. The resulting mixture was blended for 5 minutes, so that the mixture was a uniform composition to prepare a developer. Then, when the electrically charged amount of the decolorizable toner was examined by a blow-off method, the electrically charged amount was +10.1 μC/g.

Next, using the obtained developer, image stability, decolorizing property and fogging density were examined in the same manner as in Example 32. The results are shown in Table 12.

Also, when decolorizing property was examined by irradiating the obtained duplicated printed matter with visible rays to near infrared rays, it was ascertained that there was no remained color or the like and the toner was completely decolorized.

Example 37

To 20 parts by weight of toluene, 20 parts by weight of RE-9 shown in Table 7 as the resin binder, 2.5 parts by weight of DY-1 shown in Table 3 as the dye and 3.5 parts by weight of SE-1 shown in Table 2 as the decolorizing agent were added, they were stirred, dissolved and adjusted to give a uniform composition, and thereafter, the resulting composition was dried to give a dried product.

Next, using 80 parts by weight of RE-11 shown in Table 7 as the resin binder, 3 parts by weight of WA-3 shown in Table 7 as the wax and 3 parts by weight of CC-1 shown in Table 2 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a visible ray-near infrared ray-decolorizable toner having an average particle diameter of about 10 μm.

The obtained decolorizable toner was blended with a silicone resin-coated FERRITE CARRIER (made by POWDERTECH CO., LTD., F97-2535), so that the concentration of the toner was 5% by weight. The resulting mixture was blended for 5 minutes, so that the mixture was a uniform composition to prepare a developer. Then, when the electrically charged amount of the decolorizable toner was examined by a blow-off method, the electrically charged amount was +10.8 μC/g.

Next, using the obtained developer, image stability, decolorizing property and fogging density were examined in the same manner as in Example 32. The results are shown in Table 12.

Also, when decolorizing property was examined by irradiating the obtained duplicated printed matter with visible rays to near infrared rays, it was ascertained that there was no remained color or the like and the toner was completely decolorized.

Example 38

To 20 parts by weight of toluene, 20 parts by weight of RE-10 shown in Table 7 as the resin binder, 2.5 parts by weight of DY-1 shown in Table 3 as the dye and 3.5 parts by weight of SE-1 shown in Table 2 as the decolorizing agent were added, they were stirred, dissolved and adjusted to give a uniform composition, and thereafter, the resulting composition was dried to give a dried product.

Next, using 80 parts by weight of RE-11 shown in Table 7 as the resin binder, 3 parts by weight of WA-3 shown in Table 7 as the wax and 3 parts by weight of CC-1 shown in Table 2 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a decolorizable toner having an average particle diameter of about 10 μm.

The obtained decolorizable toner was blended with a silicone resin-coated FERRITE CARRIER (made by POWDERTECH CO., LTD., F97-2535), so that the concentration of the toner was 5% by weight. The resulting mixture was blended for 5 minutes, so that the mixture was a uniform composition to prepare a developer. Then, when the electrically charged amount of the decolorizable toner was examined by a blow-off method, the electrically charged amount was +12.4 μC/g.

Next, using the obtained developer, image stability, decolorizing property and fogging density were examined in the same manner as in Example 32. The results are shown in Table 12.

Also, when decolorizing property was examined by irradiating the obtained duplicated printed matter with visible rays to near infrared rays, it was ascertained that there was no remained color or the like and the toner was completely decolorized.

Comparative Example 20

Using 20 parts by weight of RE-7 and 80 parts by weight of RE-10 shown in Table 7 as the resin binders, 3 parts by weight of WA-3 shown in Table 7 as the wax, 2.5 parts by weight of DY-1 shown in Table 3 as the dye and 3.5 parts by weight of SE-1 shown in Table 2 as the decolorizing agent were blended therewith, they were heated to 130° C., molten and kneaded, thereafter cooled and pulverized to give a decolorizable toner having an average particle diameter of about 10 μm.

The obtained decolorizable toner was blended with a silicone resin-coated FERRITE CARRIER (made by POWDERTECH CO., LTD., F97-2535), so that the concentration of the toner was 5% by weight. The resulting mixture was blended for 5 minutes, so that the mixture was a uniform composition to prepare a developer. Then, when the electrically charged amount of the decolorizable toner was examined by a blow-off method, the electrically charged amount was +15.4 μC/g.

Next, using the obtained developer, image stability, decolorizing property and fogging density were examined in the same manner as in Example 32. The results are shown in Table 12.

Comparative Example 21

Using 20 parts by weight of RE-8 and 80 parts by weight of RE-11 shown in Table 7 as the resin binders, and using 2.5 parts by weight of DY-5 shown in Table 3 as the dye, SE-2 shown in Table 2 as the decolorizing agent, 3 parts by weight of WA-3 shown in Table 7 as the wax and 3 parts by weight of CC-3 shown in Table 7 as the electric charge regulator, they were heated to 130° C., molten and kneaded, thereafter cooled and pulverized to give a decolorizable toner having an average particle diameter of about 10 μm. It is ascertained that the color of the obtained kneaded mixture was somewhat faded due to fading of the dye.

The obtained decolorizable toner was blended with a silicone resin-coated FERRITE CARRIER (made by POWDERTECH CO., LTD., F97-2535), so that the concentration of the toner was 5% by weight. The resulting mixture was blended for 5 minutes, so that the mixture was a uniform composition to prepare a developer. Then, when the electrically charged amount of the decolorizable toner was examined by a blow-off method, the electrically charged amount was +16.8 μC/g.

Next, using the obtained developer, image stability, decolorizing property and fogging density were examined in the same manner as in Example 32. The results are shown in Table 12.

TABLE 12

| | Physical properties of decolorizable toner | | |
|---|---|---|---|
| | Image stability | Decolorizing property | Fogging density |
| Example No. | | | |
| 32 | A | A | 0.001 |
| 33 | A | B | 0.002 |
| 34 | A | A | 0.002 |
| 35 | A | A | 0.001 |
| 36 | A | A | 0.001 |
| 37 | B | B | 0.002 |
| 38 | B | B | 0.001 |
| Comparative Example | | | |
| 20 | C | D | 0.026 |
| 21 | C | D | 0.020 |

From the results shown in Table 12, it is understood that all of the decolorizable toners obtained in Examples 32 to 38 are excellent in image stability since they are not faded during the kneading in the production of the toner and in decolorizing property since they are speedily decolorized by irradiating with visible rays to near infrared rays, and do not generate fogging during its printing.

From the following results, it is understood that according to the process for preparing a decolorizable toner of the present invention, the decolorizable toner having desired electrically charged amount can be easily obtained since it is easy to adjust the electrically charged amount by the material having electrification property. Also, it is understood that the decolorizable toner which is excellent in coloring is obtained since the dye is not faded during the kneading in the production of the decolorizable toner.

Furthermore, it is understood that the decolorizable toner of the present invention is speedily decolorized by irradiating with visible rays to near infrared rays and does not generate fogging or the like during its printing.

Examples 39 to 43

To 20 parts by weight of toluene, 20 parts by weight of RE-13 shown in Table 13 as the resin binder, 2.5 parts by weight of DY-1 shown in Table 3 as the dye and 3.5 parts by weight of SE-5 shown in Table 13 as the decolorizing agent were added, they were stirred, dissolved and adjusted to give a uniform composition, and thereafter, the resulting composition was dried to give a dried product.

Next, using 80 parts by weight of RE-19 shown in Table 13 as the resin binder, 3 parts by weight of WA-3 shown in Table 7 as the wax and the amount shown in Table 14 of CC-1 shown in Table 2 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a decolorizable toner having positive electrification property and an average particle diameter of about 10 μm.

TABLE 13

| Raw material | Name | Contents |
|---|---|---|
| Resin binder | RE-13 | Polyester resin (softening point: 120° C. glass transition point: 70° C. acid value 28.6 mgKOH/g b* = 11.0) |
| | RE-14 | Polyester resin (softening point: 119° C. glass transition point: 67° C. acid value 33.0 mgKOH/g b* = 16.5) |
| | RE-15 | Polyester resin (softening point: 121° C. glass transition point: 68° C. acid value 0.8 mgKOH/g b* = 15.8) |
| | RE-16 | Polyester resin (softening point: 119° C. glass transition point: 67° C. acid value 16.2 mgKOH/g b* = 34.9) |
| | RE-17 | Polyester resin (softening point: 118° C. glass transition point: 68° C. acid value 33.5 mgKOH/g b* = 17.1) |
| | RE-18 | Polyester resin (softening point: 122° C. glass transition point: 70° C. acid value 1.0 mgKOH/g b* = 35.2) |
| | RE-19 | Styrene-butyl acrylate copolymer (softening point: 128° C. glass transition point: 65° C.) |
| Decolorizing agent | SE-5 | Tetrabutylammonium dibutylphenylborate |

After an iron powder carrier (made by POWDERTECH CO., LTD., Z-200B) and the obtained decolorizable toner were blended together for 5 minutes, so that the concentration of the toner was 5% by weight to prepare a developer, the electrically charged amount of the decolorizable toner was examined by a blow-off method. The results are shown in Table 14.

TABLE 14

| Ex. No. | Amount of electric charge regulator (parts by weight) | Electrically charged amount (μC/g) |
|---|---|---|
| 39 | 1 | +2.4 |
| 40 | 3 | +4.7 |
| 41 | 5 | +6.5 |
| 42 | 10 | +10.8 |
| 43 | 0 | +1.3 |

Next, on the basis of the results described in Table 14, the relation between the amount of the electric charge regulator and the electrically charged amount was examined. The results are shown as A in FIG. 3.

Comparative Examples 22 to 26

Using 20 parts by weight of RE-13 and 80 parts by weight of RE-19 shown in Table 13 as the resin binders, 3 parts by weight of WA-3 shown in Table 7 as the wax, 2.5 parts by weight of DY-1 shown in Table 3 as the dye, 3.5 parts by weight of SE-1 shown in Table 2 as the decolorizing agent and the amount shown in Table 15 of CC-5 shown in Table 7 as the electric charge regulator, they were heated to 130° C. and molten and kneaded. Then, the obtained kneaded mixture was cooled, and thereafter pulverized to give a decolorizable toner having positive electrification property and an average particle diameter of about 10 μm.

Using the obtained decolorizable toner, a developer was prepared in the same manner as in Examples 39 to 43, and thereafter the electrically charged amount of the decolorizable toner was examined. The results are shown in Table 15.

TABLE 15

| Com. Ex. No. | Amount of electric charge regulator (parts by weight) | Electrically charged amount (μC/g) |
|---|---|---|
| 22 | 1 | +14.3 |
| 23 | 3 | +15.2 |
| 24 | 5 | +15.6 |
| 25 | 10 | +15.8 |
| 26 | 0 | +13.5 |

Next, on the basis of the results described in Table 15, the relation between the amount of the electric charge regulator and the electrically charged amount was examined. The results are shown as B in FIG. 3.

Figure 3:
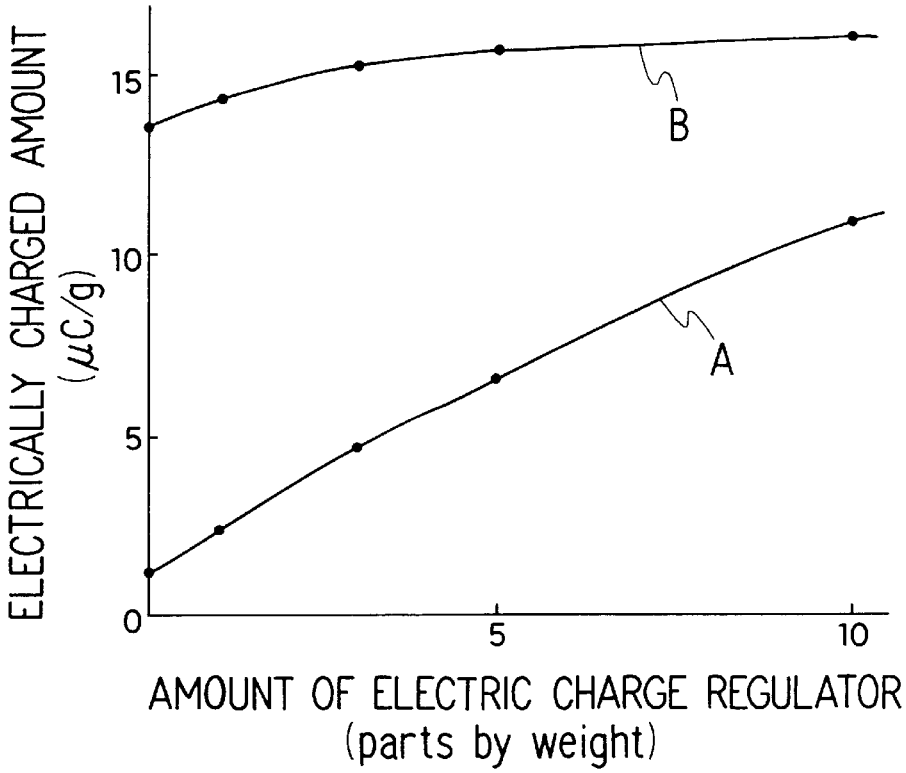
FIG. 3 is a graph showing the relation between the amount of the electric charge regulator and the electrically charged amount of the decolorizable toners obtained in Examples 39 to 43 and Comparative Examples 22 to 26.

From the results shown in FIG. 3, it is understood that according to the methods in Examples 39 to 43 (A in FIG. 3), the electrically charged amount of the obtained decolorizable toners can be easily adjusted to a predetermined value by adjusting the amount of the electric charge regulator.

To the contrary, it is understood that according to the methods in Comparative Examples 22 to 26 (B in FIG. 3), adjusting the electrically charged amount of the obtained decolorizable toners to a predetermined value is difficult by adjusting the amount of the electric charge regulator.

Examples 44 to 47

To 20 parts by weight of toluene, 20 parts by weight of RE-13 shown in Table 13 as the resin binder, 2.5 parts by weight of DY-1 shown in Table 3 as the dye and 3.5 parts by weight of SE-1 shown in Table 2 as the decolorizing agent were added, they were stirred, dissolved and adjusted to give a uniform composition, and thereafter, the resulting composition was dried to give a dried product.

Next, using 80 parts by weight of RE-19 shown in Table 13 as the resin binder, 3 parts by weight of WA-3 shown in Table 7 as the wax and the amount shown in Table 16 of CC-5 shown in Table 2 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a decolorizable toner having negative electrification property and an average particle diameter of about 10 μm.

The obtained decolorizable toner and an iron powder carrier (made by POWDERTECH CO., LTD., Z-200B) were blended together for 5 minutes, so that the concentration of the toner was 5% by weight to prepare a developer. Then, the electrically charged amount of the decolorizable toner was examined by a blow-off method. The results are shown in Table 16.

TABLE 16

| Ex. No. | Amount of electric charge regulator (parts by weight) | Electrically charged amount (μC/g) |
|---|---|---|
| 44 | 1 | −5.1 |
| 45 | 3 | −15.4 |
| 46 | 5 | −19.8 |
| 47 | 10 | −38.0 |

Next, on the basis of the results described in Table 16, the relation between the amount of the electric charge regulator and the electrically charged amount was examined. The results are shown as A in FIG. 4.

Comparative Examples 27 to 30

Using 20 parts by weight of RE-13 and 80 parts by weight of RE-19 shown in Table 13 as the resin binders, 3 parts by weight of WA-3 shown in Table 7 as the wax, 2.5 parts by weight of DY-1 shown in Table 3 as the dye, 3.5 parts by weight of SE-1 shown in Table 2 as the decolorizing agent and the amount shown in Table 17 of CC-5 shown in Table 7 as the electric charge regulator, they were heated to 130° C. and molten and kneaded. Then, the obtained kneaded mixture was cooled, and thereafter pulverized to give a visible ray-near infrared ray-decolorizable having positive electrification property and an average particle diameter of about 10 μm.

Using the obtained decolorizable toner, after a developer was prepared in the same manner as in Examples 44 to 47, the electrically charged amount of the decolorizable toner was examined. The results are shown in Table 17.

TABLE 17

| Com. Ex. No. | Amount of electric charge regulator (parts by weight) | Electrically charged amount (μC/g) |
|---|---|---|
| 27 | 1 | +4.1 |
| 28 | 3 | +5.4 |
| 29 | 5 | +1.9 |
| 30 | 10 | −2.1 |

Next, on the basis of the results described in Table 17, the relation between the amount of the electric charge regulator and the electrically charged amount was examined. The results are shown as B in FIG. 4.

Figure 4:
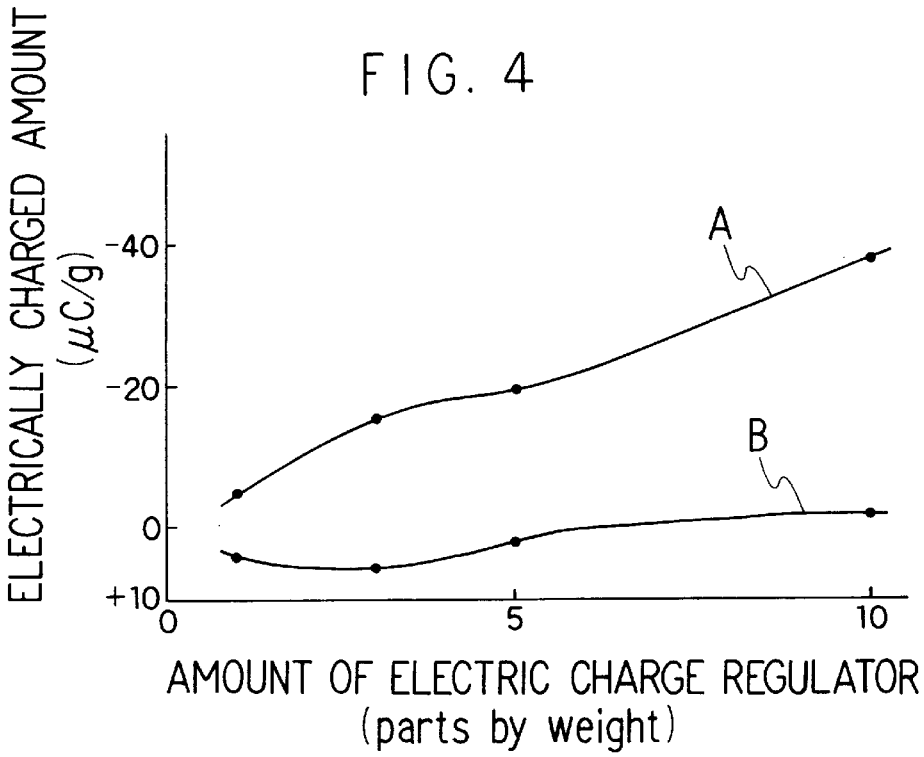
FIG. 4 is a graph showing the relation between the amount of the electric charge regulator and the electrically charged amount of the decolorizable toners obtained in Examples 44 to 47 and Comparative Examples 27 to 30.

From the results shown in FIG. 4, it is understood that according to the methods in Examples 44to 47 (A in FIG. 4), the electrically charged amount of the obtained decolorizable toners can be easily adjusted to a predetermined value by adjusting the amount of the electric charge regulator.

To the contrary, it is understood that according to the methods in Comparative Examples 27 to 30 (B in FIG. 4), adjusting the electrically charged amount of the obtained decolorizable toners to a predetermined value is difficult by adjusting the amount of the electric charge regulator.

Example 48

To 20 parts by weight of toluene, 20 parts by weight of RE-14 shown in Table 13 as the resin binder, 2.5 parts by weight of DY-1 shown in Table 3 as the dye and 3.5 parts by weight of SE-1 shown in Table 2 as the decolorizing agent were added, they were stirred, dissolved and adjusted to give a uniform composition, and thereafter, the resulting composition was dried to give a dried product.

Next, using 80 parts by weight of RE-19 shown in Table 13 as the resin binder, 3 parts by weight of WA-3 shown in Table 3 as the wax and 3 parts by weight of CC-5 shown in Table 7 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a decolorizable toner having positive electrification property and an average particle diameter of about 10 μm.

A silicone resin-coated FERRITE CARRIER (made by POWDERTECH CO., LTD., F97-2535) and the obtained decolorizable toner were blended together for 5 minutes, so that the concentration of the toner was 5% by weight to prepare a developer. Then, when the electrically charged amount of the decolorizable toner was examined by a blow-off method, the electrically charged amount was +9.8 μC/g.

Next, the obtained developer was set in a copying machine (made by Ricoh Company, Ltd., FT-4525), image stability, decolorizing property and fogging density were examined in the same manner as in Examples 1 to 22 and remained color was examined in the following method. The results are shown in Table 18.

(1) Remained color (degree of yellowing)

The image sample for evaluation of the obtained decolorizable toner was decolorized under the condition that the toner could be completely decolorized.

After decolorizing, non-duplicated papers were involved in the image samples, 5 sheets each thereof were randomly put on a perpendicular wall, and the duplicated samples after decolorizing were distinguished from the non-duplicated papers with naked eyes at a distance of 5 m from the wall. This distinction was carried out by 10 persons in total of 5 males and 5 females. After decolorizing, the case that the duplicated sample was recognized as the non-duplicated paper was counted as 1 point, and the evaluation was carried out by the total points of the 10 persons in accordance with the following criteria for evaluation.

(Criteria for evaluation)

A: 40 to 50 points

B: 30 to 39 points

C: 20 to 29 points

D: 0 to 19 points

Example 49

To 20 parts by weight of toluene, 20 parts by weight of RE-14 shown in Table 13 as the resin binder, 2.5 parts by weight of DY-1 shown in Table 3 as the dye and 3.5 parts by weight of SE-1 shown in Table 2 as the decolorizing agent were added, they were stirred, dissolved and adjusted to give a uniform composition, and thereafter, the resulting composition was dried to give a dried product.

Next, using 80 parts by weight of RE-19 shown in Table 13 as the resin binder, 3 parts by weight of WA-3 shown in Table 7 as the wax and 3 parts by weight of CC-1 shown in Table 2 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a decolorizable toner having an average particle diameter of about 10 μm.

The obtained decolorizable toner and a silicone resin-coated FERRITE CARRIER (made by POWDERTECH CO., LTD., F97-2535) were blended together, so that the concentration of the toner was 5% by weight. The resulting mixture was blended for 5 minutes, so that the mixture was a uniform composition to prepare a developer. Then, when the electrically charged amount of the decolorizable toner was examined by a blow-off method, the electrically charged amount was +10.5 μC/g.

Next, using the obtained developer, image stability, decolorizing property, remained color and fogging density were examined in the same manner as in Example 48. The results are shown in Table 18.

Example 50

To 20 parts by weight of toluene, 20 parts by weight of RE-15 shown in Table 13 as the resin binder, 2.5 parts by weight of DY-1 shown in Table 3 as the dye and 3.5 parts by weight of SE-1 shown in Table 2 as the decolorizing agent were added, they were stirred, dissolved and adjusted to give a uniform composition, and thereafter, the resulting composition was dried to give a dried product.

Next, using 80 parts by weight of RE-19 shown in Table 13 as the resin binder, 3 parts by weight of WA-3 shown in Table 7 as the wax and 3 parts by weight of CC-1 shown in Table 2 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a decolorizable toner having an average particle diameter of about 10 μm.

The obtained decolorizable toner and a silicone resin-coated FERRITE CARRIER (made by POWDERTECH CO., LTD., F97-2535) were blended together, so that the concentration of the toner was 5% by weight. The resulting mixture was blended for 5 minutes, so that the mixture was a uniform composition to prepare a developer. Then, when the electrically charged amount of the decolorizable toner was examined by a blow-off method, the electrically charged amount was +9.2 μC/g.

Next, using the obtained developer, image stability, decolorizing property, remained color and fogging density were examined in the same manner as in Example 48. The results are shown in Table 18.

Example 51

To 20 parts by weight of toluene, 20 parts by weight of RE-16 shown in Table 13 as the resin binder, 2.0 parts by weight of DY-1 shown in Table 3 as the dye and 3.5 parts by weight of SE-1 shown in Table 2 as the decolorizing agent were added, they were stirred, dissolved and adjusted to give a uniform composition, and thereafter, the resulting composition was dried to give a dried product.

Next, using 80 parts by weight of RE-19 shown in Table 13 as the resin binder, 3 parts by weight of WA-3 shown in Table 7 as the wax and 3 parts by weight of CC-1 shown in Table 2 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a decolorizable toner having an average particle diameter of about 10 μm.

The obtained decolorizable toner and a silicone resin-coated FERRITE CARRIER (made by POWDERTECH CO., LTD., F97-2535) were blended together, so that the concentration of the toner was 5% by weight. The resulting mixture was blended for 5 minutes, so that the mixture was a uniform composition to prepare a developer. Then, when the electrically charged amount of the decolorizable toner was examined by a blow-off method, the electrically charged amount was +10.1 μC/g.

Next, using the obtained developer, image stability, decolorizing property and fogging density were examined in the same manner as in Example 48. The results are shown in Table 18.

Example 52

To 20 parts by weight of toluene, 20 parts by weight of RE-13 shown in Table 13 as the resin binder, 2.5 parts by weight of DY-1 shown in Table 3 as the dye and 3.5 parts by weight of SE-1 shown in Table 2 as the decolorizing agent were added, they were stirred, dissolved and adjusted to give a uniform composition, and thereafter, the resulting composition was dried to give a dried product.

Next, using 80 parts by weight of RE-19 shown in Table 13 as the resin binder, 3 parts by weight of WA-3 shown in Table 7 as the wax and 3 parts by weight of CC-1 shown in Table 2 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a visible ray-near infrared ray-decolorizable toner having an average particle diameter of about 10 μm.

The obtained decolorizable toner and a silicone resin-coated FERRITE CARRIER (made by POWDERTECH CO., LTD., F97-2535) were blended together, so that the concentration of the toner was 5% by weight. The resulting mixture was blended for 5 minutes, so that the mixture was a uniform composition to prepare a developer. Then, when the electrically charged amount of the decolorizable toner was examined by a blow-off method, the electrically charged amount was +10.8 μC/g.

Next, using the obtained developer, image stability, decolorizing property, remained color and fogging density were examined in the same manner as in Example 48. The results are shown in Table 18.

Example 53

To 20 parts by weight of toluene, 20 parts by weight of RE-18 shown in Table 13 as the resin binder, 2.5 parts by weight of DY-1 shown in Table 3 as the dye and 3.5 parts by weight of SE-1 shown in Table 2 as the decolorizing agent were added, they were stirred, dissolved and adjusted to give a uniform composition, and thereafter, the resulting composition was dried to give a dried product.

Next, using 80 parts by weight of RE-19 shown in Table 13 as the resin binder, 3 parts by weight of WA-3 shown in Table 7 as the wax and 3 parts by weight of CC-1 shown in Table 2 as the electric charge regulator, they were heated to 130° C. and molten and kneaded. Then, 26 parts by weight of the above dried product was added thereto and they were molten and kneaded. The obtained kneaded mixture was cooled, and thereafter pulverized to give a decolorizable toner having an average particle diameter of about 10 μm.

The obtained decolorizable toner and a silicone resin-coated FERRITE CARRIER (made by POWDERTECH CO., LTD., F97-2535) were blended together, so that the concentration of the toner was 5% by weight. The resulting mixture was blended for 5 minutes, so that the mixture was a uniform composition to prepare a developer. Then, when the electrically charged amount of the decolorizable toner was examined by a blow-off method, the electrically charged amount was +9.6 μC/g.

Next, using the obtained developer, image stability, decolorizing property, remained color and fogging density were examined in the same manner as in Example 48. The results are shown in Table 18.

Comparative Example 31

Using 20 parts by weight of RE-13 and 80 parts by weight of RE-15 shown in Table 13 as the resin binders, 3 parts by weight of WA-3 shown in Table 7 as the wax, 2.5 parts by weight of DY-1 shown in Table 3 as the dye and 3.5 parts by weight of SE-1 shown in Table 2 as the decolorizing agent were blended therewith, they were heated to 130° C., molten and kneaded, thereafter cooled, and pulverized to give a decolorizable toner having an average particle diameter of about 10 μm.

The obtained decolorizable toner and a silicone resin-coated FERRITE CARRIER (made by POWDERTECH CO., LTD., F97-2535) were blended together, so that the concentration of the toner was 5% by weight. The resulting mixture was blended for 5 minutes, so that the mixture was a uniform composition to prepare a developer. Then, when the electrically charged amount of the decolorizable toner was examined by a blow-off method, the electrically charged amount was +15.4 μC/g.

Next, using the obtained developer, image stability, decolorizing property, remained color and fogging density were examined in the same manner as in Example 48. The results are shown in Table 18.

Comparative Example 32

Using 20 parts by weight of RE-13 and 80 parts by weight of RE-19 shown in Table 13 as the resin binder, and using 2.5 parts by weight of DY-13 shown in Table 13 as the dye, 3.5 parts by weight of SE-1 shown in Table 2 as the decolorizing agent, 3 parts by weight of WA-3 shown in Table 7 as the wax and 3 parts by weight of CC-1 shown in Table 2 as the electric charge regulator, they were heated to 130° C., molten and kneaded, thereafter cooled, and pulverized to give a decolorizable toner having an average particle diameter of about 10 μm.

The obtained decolorizable toner and a silicone resin-coated FERRITE CARRIER (made by POWDERTECH CO., LTD., F97-2535) were blended together, so that the concentration of the toner was 5% by weight. The resulting mixture was blended for 5 minutes, so that the mixture was a uniform composition to prepare a developer. Then, when the electrically charged amount of the decolorizable toner was examined by a blow-off method, the electrically charged amount was +16.8 μC/g.

Next, using the obtained developer, image stability, decolorizing property, remained color and fogging density were examined in the same manner as in Example 48. The results are shown in Table 18.

TABLE 18

| | Physical properties of decolorizable toner | | | | |
|---|---|---|---|---|---|
| Ex. No. | Electrically charged amount (μC/g) | Image stability | Decolorizing property | Remained color | Fogging density |
| 48 | +9.8 | A | A | A | 0.001 |
| 49 | +10.5 | A | C | C | 0.002 |
| 50 | +9.2 | C | A | A | 0.002 |
| 51 | +10.1 | A | A | C | 0.002 |
| 52 | +10.8 | A | C | C | 0.002 |
| 53 | +9.6 | C | B | C | 0.002 |

TABLE 18-continued

| | Physical properties of decolorizable toner | | | | |
|---|---|---|---|---|---|
| | Electrically charged amount ($\mu$C/g) | Image stability | Decolorizing property | Remained color | Fogging density |
| Com. Ex. | | | | | |
| 31 | +15.4 | D | C | D | 0.009 |
| 32 | +16.8 | C | D | D | 0.007 |

From the results shown in Table 18, it is understood that all of the decolorizable toners obtained in Examples 48 to 53 are excellent in image stability since they are not faded during the kneading in the production of the toner and in decolorizing property since they are speedily decolorized by irradiating with visible rays to near infrared rays, and do not generate remained color and also fogging density during its printing.

From the above results, it is understood that according to the process for preparing the visible ray-near infrared ray-decolorizable toner of the present invention, the visible ray-near infrared ray-decolorizable toner having desired electrically charged amount can be easily obtained since it is easy to adjust the electrically charged amount by the material having electrification property. Also, the visible ray-near infrared ray-decolorizable toner which is excellent in coloring is obtained since the dye is not faded during the kneading in the production of the visible ray-near infrared ray-decolorizable toner.

Also, it is understood that there are exerted effects that the visible ray-near infrared ray-decolorizable toner of the present invention is speedily decolorized by irradiating with visible rays to near infrared rays and does not generate fogging or the like during its printing.

Industrial Applicability

There are exerted effects that the decolorizable toner of the present invention can be speedily decolorized during its decolorizing and is excellent in quality of the formed image therefrom.

Also, according to the process for preparing the decolorizable toner of the present invention, there are exerted effects that it is easy to adjust the electrically charged amount of the obtained decolorizable toner and that the dye is hardly faded during kneading in the production of the toner.

We claim:

1. A decolorizable toner comprising a visible ray-near infrared ray-absorbing dye, a decolorizing agent and a resin binder, said toner comprising a continuous phase of a resin binder B and a dispersed phase of a resin binder A having an acid value of 8 to 30 mg KOH/g which is incompatible with said resin binder B and is dispersed in said resin binder B, wherein said visible ray-near infrared ray-absorbing dye and said decolorizing agent are incorporated in said resin binder A.

2. The decolorizable toner of claim 1, wherein the resin binder A has a b* value of not more than 20 in the chromaticity coordinates L*a*b as measured by means of a color-difference meter in a 30% ethyl acetate solution thereof.

3. The decolorizable toner of claim 1, wherein the resin binder B contains a material having electrification property.

4. The decolorizable toner of claim 1, wherein said resin binder A has an acid value of 12.6 to 30 mg KOH/g.

5. The decolorizable toner of claim 1, wherein said resin binder B is a member selected from the group consisting of styrene homopolymer, styrene-acrylic copolymers, styrene-acrylonitrile copolymers, styrene-p-chlorostyrene copolymers, styrene-propylene copolymers, styrene-vinyltoluene copolymers, styrene vinylnaphthalene copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers, acrylic resins, methacrylic resins, polyester resins, ethylene-vinyl acetate copolymers, olefin resins, epoxy resins, vinyl chloride resins, silicone resins, fluorocarbon resins, polyamide resins, polyvinyl alcohol resins, polyurethane resins, polyvinyl butyral, rosin, rosin-modified phenol-formaldehyde resin, phenol-formaldehyde resin, phenolic resins, vinyl acetate resins, a terpene resin, aliphatic or alicyclic hydrocarbon resins, and aromatic petroleum resins, and said resin binder A is selected from the group consisting of styrene maleic acid copolymers, rosin and rosin-modified phenol-formaldehyde resin.

6. A process for preparing a decolorizable toner comprising a visible ray-near infrared ray-absorbing dye, a decolorizing agent and a resin binder, which comprises melt-kneading a resin binder A having an acid value of 8 to 30 mg KOH/g and containing the visible ray-near infrared ray-absorbing dye and the decolorizing agent with a resin binder B incompatible with said resin binder A so as to disperse said resin binder A into said resin binder B, cooling the resulting mixture of said resin binders A and B and thereafter pulverizing said mixture.

7. The process of claim 6, wherein the resin binder A containing the visible ray-near infrared ray-absorbing dye and the decolorizing agent is prepared by dissolving the visible ray-near infrared ray-absorbing dye, the decolorizing agent and the binder in an organic solvent, blending or kneading them, and then removing the organic solvent therefrom.

8. The process of claim 6, wherein the resin binder A has a b* value of not more than 20 in the chromaticity coordinates L*a*b as measured by means of a color-difference meter in a 30% ethyl acetate solution thereof.

9. The process of claim 6, wherein the resin binder B contains a material having electrification property.

* * * * *

UNITED STATES PATENT AND TRADEMARK OFFICE

CERTIFICATE OF CORRECTION

PATENT NO. : 5,814,427

DATED : September 29, 1998

INVENTOR(S) : Murofushi, et al

It is certified that error appears in the above-indentified patent and that said Letters Patent is hereby corrected as shown below:

Column 8, line 17, "n-ethyltriphenylborate" should read --ethyltriphenylborate--.

Column 8, line 19, "n-methyltri-p-tolylborate" should read --methyltri-p-tolylborate--.

Column 8, line 19, "n-ethyltri-p-tolylborate" should read --ethyltri-p-tolylborate--.

Column 8, line 21, "n-methyltrianisylborate" should read --methyltrianisylborate--.

Column 8, line 22, "n-ethyltrianisylborate" should read --ethyltrianisylborate--.

Column 8, line 24, "di-n-methyldiphenylborate" should read --dimethyldiphenylborate--.

Column 8, line 24, "di-n-ethyldiphenylborate" should read --diethyldiphenylborate--.

Column 8, line 26, "di-n-methyldi-p-" should read --dimethyldi-p- --.

Column 8, line 27, "di-n-ethyldi-p-tolylborate" should read --diethyldi-p-tolylborate--.

Column 8, line 29, "di-n-methyldianisylborate" should read --dimethyldianisylborate--.

Column 8, line 30, "di-n-ethyldianisylborate" should read --diethyldianisylborate--.

Column 8, line 41, delete "thiazine".

UNITED STATES PATENT AND TRADEMARK OFFICE

CERTIFICATE OF CORRECTION

PATENT NO. : 5,814,427

DATED : September 29, 1998

INVENTOR(S) : Murofushi, et al

It is certified that error appears in the above-indentified patent and that said Letters Patent is hereby corrected as shown below:

Column 27, line 17, "n-methyltriphenylborate" should read --methyltriphenylborate--.

Column 27, line 21, "n-methyltri-p-tolylborate" should read --methyltri-p-tolylborate--.

Column 27, line 25, "n-methyltrianisylborate" should read --methyltrianisylborate--.

Column 27, line 29, "n-methyltriphenylborate" should read --methyltriphenylborate--.

Column 27, line 33, "n-methyltri-p-tolylborate" should read --methyltri-p-tolylborate--.

Column 27, line 37, "n-methyltrianisylborate" should read --methyltrianisylborate--.

Column 27, line 41, "n-methyltriphenylborate" should read --methyltriphenylborate--.

Column 27, line 45, "n-methyltri-p-tolylborate" should read --methyltri-p-tolylborate--.

Column 27, line 49, "n-methyltrianisylborate" should read --methyltrianisylborate--.

Column 27, line 53, "n-methyltriphenylborate" should read --methyltriphenylborate--.

Column 27, line 57, "n-methyltri-p-tolylborate" should read --methyltri-p-tolylborate--.

Column 27, line 61, "n-methyltrianisylborate" should read --methyltrianisylborate--.

Column 27, line 65, "di-n-methyldiphenylborate" should read --dimethyldiphenylborate--.

UNITED STATES PATENT AND TRADEMARK OFFICE

CERTIFICATE OF CORRECTION

PATENT NO. : 5,814,427

DATED : September 29, 1998

INVENTOR(S) : Murofushi, et al

It is certified that error appears in the above-indentified patent and that said Letters Patent is hereby corrected as shown below:

Column 28, line 2, "di-n-methyldi-p-tolylborate" should read --dimethyldi-p-tolylborate--.

Column 28, line 6, "di-n-methyldianisylborate" should read --dimethyldianisylborate--.

Column 28, line 10, "di-n-methyldiphenylborate" should read --dimethyldiphenylborate--.

Column 28, line 13, "di-n-methyldi-p-tolylborate" should read --dimethyldi-p-tolylborate--.

Column 28, line 17, "di-n-methyldianisylborate" should read --dimethyldianisylborate--.

Column 28, line 21, "di-n-methyldiphenylborate" should read --dimethyldiphenylborate--.

Column 28, line 25, "di-n-methyldi-p-tolylborate" should read --dimethyldi-p-tolylborate--.

Column 28, line 29, "di-n-methyldianisylborate" should read --dimethyldianisylborate--.

Column 28, line 33, "di-n-methyldiphenylborate" should read --dimethylphenylborate--.

Column 28, line 37, "di-n-methyldi-p-tolylborate" should read --dimethyldi-p-tolylborate--.

UNITED STATES PATENT AND TRADEMARK OFFICE

CERTIFICATE OF CORRECTION

PATENT NO. : 5,814,427

DATED : September 29, 1998

INVENTOR(S) : Murofushi, et al

It is certified that error appears in the above-indentified patent and that said Letters Patent is hereby corrected as shown below:

Column 28, line 41, "di-n-methyldianisylborate" should read --dimethyldianisylborate--.

Column 42, line 4, before "liquid" insert --high pressure--.

Column 43, TABLE 3,

" DY-3

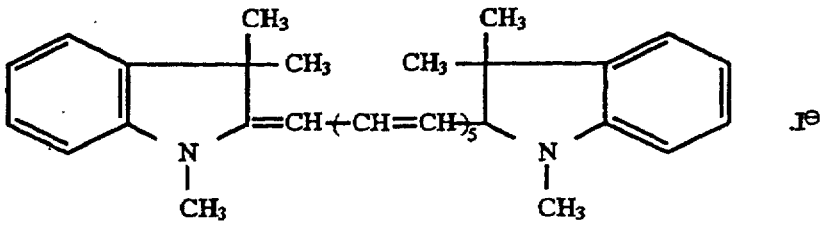

should read

UNITED STATES PATENT AND TRADEMARK OFFICE

CERTIFICATE OF CORRECTION

PATENT NO. : 5,814,427 Page 5 of 6

DATED : September 29, 1998

INVENTOR(S) : Murofushi, et al

It is certified that error appears in the above-indentified patent and that said Letters Patent is hereby corrected as shown below:

-- DY-3

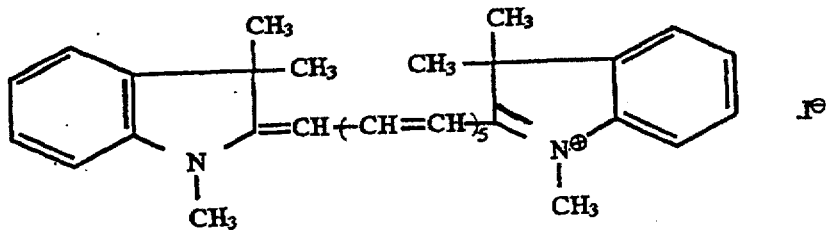

--.

Column 43, TABLE 3,

" DY-4

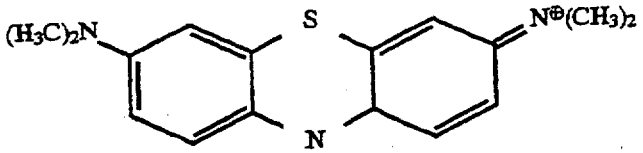

"

should read

-- DY-4

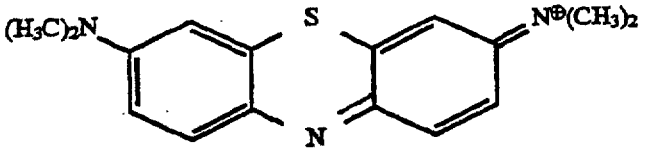

--.

UNITED STATES PATENT AND TRADEMARK OFFICE

CERTIFICATE OF CORRECTION

PATENT NO. : 5,814,427

DATED : September 29, 1998

INVENTOR(S) : Murofushi, et al

It is certified that error appears in the above-indentified patent and that said Letters Patent is hereby corrected as shown below:

Column 45, TABLE 3-continued, "n-c6$H_{13}$" should read --n-$C_6H_{13}$--.
Column 52, line 3, "$|xi-xi-1| \leq 0.05$" should read --$|xi-(xi-1)| \leq 0.05$--.

Signed and Sealed this

Twelfth Day of October, 1999

*Attest:*

*Attesting Officer*

Q. TODD DICKINSON

*Acting Commissioner of Patents and Trademarks*